US008449054B2

(12) United States Patent
Harris et al.

(10) Patent No.: US 8,449,054 B2
(45) Date of Patent: May 28, 2013

(54) INK JET PRINTER

(75) Inventors: Steven Richard Harris, Northampton (GB); Peter Kassner, Algarve (PT); Philip John Blowfield, Northants (GB)

(73) Assignee: Videojet Technologies Inc.

( * ) Notice: Subject to any disclaimer, the term of this patent is extended or adjusted under 35 U.S.C. 154(b) by 102 days.

(21) Appl. No.: 12/680,974

(22) PCT Filed: Oct. 9, 2008

(86) PCT No.: PCT/GB2008/003424
§ 371 (c)(1),
(2), (4) Date: Mar. 31, 2010

(87) PCT Pub. No.: WO2009/047511
PCT Pub. Date: Apr. 16, 2009

(65) Prior Publication Data

US 2010/0238206 A1 Sep. 23, 2010

(30) Foreign Application Priority Data

Oct. 12, 2007 (GB) ..... 0720289.8

(51) Int. Cl.
*B41J 29/38* (2006.01)

(52) U.S. Cl.
USPC ..... 347/7; 347/86; 702/55

(58) Field of Classification Search
USPC ..... 347/5, 7, 19, 85, 86, 101; 702/55
See application file for complete search history.

(56) References Cited

U.S. PATENT DOCUMENTS

| | | | | |
|---|---|---|---|---|
| 5,315,317 | A * | 5/1994 | Terasawa et al. | 347/7 |
| 5,506,611 | A | 4/1996 | Ujita | |
| 5,860,363 | A | 1/1999 | Childers | |
| 6,010,210 | A | 1/2000 | Wilson | |
| 6,065,824 | A | 5/2000 | Bullock | |
| 6,130,695 | A | 10/2000 | Childers | |
| 6,196,670 | B1 | 3/2001 | Saruta | |
| 6,360,174 | B1 * | 3/2002 | Shoki | 702/55 |
| 6,416,152 | B1 | 7/2002 | Matsuzaki | |
| 6,585,359 | B1 | 7/2003 | Gasvoda | |
| 6,672,695 | B1 | 1/2004 | Tojyo | |
| 6,705,712 | B2 | 3/2004 | Usui | |
| 6,789,876 | B2 | 9/2004 | Barclay | |
| 6,830,323 | B2 | 12/2004 | Perkins | |
| 6,862,652 | B1 | 3/2005 | Tsuji | |
| 7,077,512 | B2 | 7/2006 | Kobayashi | |
| 7,168,797 | B2 | 1/2007 | Arai | |
| 7,434,900 | B2 | 10/2008 | Slomianny | |

(Continued)

FOREIGN PATENT DOCUMENTS

GB 2350220 11/2000

*Primary Examiner* — Lam S Nguyen
(74) *Attorney, Agent, or Firm* — Joseph A. Yosick

(57) ABSTRACT

An ink jet printer comprising a printing fluid cartridge receiving portion arranged to receive a printing fluid cartridge (2) and to allow passage of printing fluid from a received printing fluid cartridge to printing fluid conduits of the ink jet printer; a data reader arranged to read data indicating a quantity of fluid within a received cartridge from an electronic data storage device associated with the received printing fluid cartridge; and a controller arranged to generate update data usable to modify data stored on said electronic data storage device and to modify data stored on said electronic storage device based upon said update data such that data stored on said electronic data storage device indicates an updated quantity of fluid in said printing fluid cartridge.

10 Claims, 19 Drawing Sheets

U.S. PATENT DOCUMENTS

2002/0001009 A1 1/2002 Gasvoda
2002/0196312 A1 12/2002 Ishizawa
2003/0206220 A1 11/2003 Childers
2004/0056910 A1 3/2004 Usui
2005/0024398 A1 2/2005 Kanamaru

* cited by examiner

INK JET PRINTER

RELATED APPLICATIONS

This application claims priority under 35U.S.C. § 371from PCT Application No. PCT/GB2008/003424, filed in English on Oct. 9, 2008, which claims the benefit of Great Britain Application Serial No. 0720289.8filed on Oct. 12, 2007, the disclosures of which are incorporated by reference herein in their entireties The present invention relates to an ink jet printer and to an ink supply system for an ink jet printer such as a continuous ink jet printer.

In ink jet printing systems the print is made up of individual droplets of ink generated at a nozzle and propelled towards a substrate. There are two principal systems: drop on demand where ink droplets for printing are generated as and when required; and continuous ink jet printing in which droplets are continuously produced and only selected ones are directed towards the substrate, the others being recirculated to an ink supply.

Continuous ink jet printers supply pressurised ink to a print head drop generator where a continuous stream of ink emanating from a nozzle is broken up into individual regular drops by an oscillating piezoelectric element. The drops are directed past a charge electrode where they are selectively and separately given a predetermined charge before passing through a transverse electric field provided across a pair of deflection plates. Each charged drop is deflected by the field by an amount that is dependent on its charge magnitude before impinging on the substrate whereas the uncharged drops proceed without deflection and are collected at a gutter from where they are recirculated to the ink supply for reuse. The charged drops bypass the gutter and hit the substrate at a position determined by the charge on the drop and the position of the substrate relative to the print head. Typically the substrate is moved relative to the print head in one direction and the drops are deflected in a direction generally perpendicular thereto, although the deflection plates may be oriented at an inclination to the perpendicular to compensate for the speed of the substrate (the movement of the substrate relative to the print head between drops arriving means that a line of drops would otherwise not quite extend perpendicularly to the direction of movement of the substrate).

In continuous ink jet printing a character is printed from a matrix comprising a regular array of potential drop positions. Each matrix comprises a plurality of columns (strokes), each being defined by a line comprising a plurality of potential drop positions (e.g. seven) determined by the charge applied to the drops. Thus each usable drop is charged according to its intended position in the stroke. If a particular drop is not to be used then the drop is not charged and it is captured at the gutter for recirculation. This cycle repeats for all strokes in a matrix and then starts again for the next character matrix.

Ink is delivered under pressure to the print head by an ink supply system that is generally housed within a sealed compartment of a cabinet that includes a separate compartment for control circuitry and a user interface panel. The system includes a main pump that draws the ink from a reservoir or tank via a filter and delivers it under pressure to the print head. As ink is consumed the reservoir is refilled as necessary from a replaceable ink cartridge that is releasably connected to the reservoir by a supply conduit. The ink is fed from the reservoir via a flexible delivery conduit to the print head. The unused ink drops captured by the gutter are recirculated to the reservoir via a return conduit by a pump. The flow of ink in each of the conduits is generally controlled by solenoid valves and/or other like components.

As the ink circulates through the system, there is a tendency for it to thicken as a result of solvent evaporation, particularly in relation to the recirculated ink that has been exposed to air in its passage between the nozzle and the gutter. In order to compensate for this "make-up" solvent is added to the ink as required from a replaceable solvent cartridge so as to maintain the ink viscosity within desired limits. This solvent may also be used for flushing components of the print head, such as the nozzle and the gutter, in a cleaning cycle. It will be appreciated that circulation of the solvent requires further fluid conduits and therefore that the ink supply system as a whole comprises a significant number of conduits connected between different components of the ink supply system. The many connections between the components and the conduits all represent a potential source of leakage and loss of pressure. Given that continuous ink jet printers are typically used on production lines for long uninterrupted periods reliability is an important issue. Moreover, the presence of multiple conduits in the interior of the ink supply section of the cabinet makes access to certain components difficult in the event of servicing or repair.

It is one object of the present invention, amongst others, to provide for an improved or an alternative ink jet printer and/or an alternative or improved ink supply system for an ink jet printer.

According to the present invention, there is provided ink jet printer comprising: a printing fluid cartridge receiving portion arranged to receive a printing fluid cartridge and to allow passage of printing fluid from a received printing fluid cartridge to printing fluid conduits of the ink jet printer; a data reader arranged to read data indicating a quantity of fluid within a received cartridge from an electronic data storage device associated with the received printing fluid cartridge; and a controller arranged to generate update data usable to modify data stored on said electronic data storage device and to modify data stored on said electronic storage device based upon said update data such that data stored on said electronic data storage device indicates an updated quantity of fluid in said printing fluid cartridge.

In this way, the ink jet printer is arranged such that an electronic data storage device associated with a printing fluid cartridge stores data providing an up to date indication of the quantity of fluid within the printing fluid cartridge. As printing fluid is used, the stored data is updated. If a printing fluid cartridge is removed from a first printer and inserted into the second printer, the second printer can use data stored on the electronic data storage device to obtain an indication of a quantity of printing fluid within the printing fluid cartridge, without any assumption as to usage of the printing fluid cartridge, and without any prior knowledge of use of the printing fluid cartridge.

The printing fluid contained in the printing fluid cartridge is typically a liquid ink or solvent.

The controller may be arranged to determine a quantity of fluid within said printing fluid cartridge and to generate said update data based upon said determination. Determination of the quantity of fluid within the printing fluid cartridge can be carried out in any suitable way. For example the controller may be arranged to determine a quantity of fluid within said printing fluid cartridge based upon a quantity of fluid removed from said printing fluid cartridge. Determination of a quantity of fluid removed from the printing fluid cartridge may be based upon a quantity of fluid used in printing operations, for example a quantity of ink provided from a print head of the ink jet printer. The controller may be arranged to determine a quantity of fluid within said printing fluid cartridge based upon at least one property of said printing fluid cartridge and/or at least one property of fluid within said printing fluid cartridge, for example based upon a pressure within said printing fluid cartridge.

The electronic data storage device associated with the printing fluid cartridge may store first data indicating a quantity of fluid initially stored in said printing fluid cartridge, and second data indicating a quantity of fluid removed from the printing fluid cartridge. The update data may be arranged to modify said second data. The second data may comprise a predetermined number of data elements having first and second states, each data element being associated with a predetermined quantity of ink, and said quantity of ink removed from the printing fluid cartridge may be represented by a number of data elements set to the first state. Each of the data elements may be a bit.

Determining the update data may comprise determining a current quantity of fluid in said printing fluid cartridge; determining a difference between said initial quantity of fluid and said current quantity of fluid; and generating said update data based upon said difference.

The data reader may be arranged to read said first data and said second data. The controller may be arranged to subtract a quantity based upon said second data from a quantity based upon said first data. The data reader may comprise a plurality of electrical contacts arranged to make contact with corresponding electrical contacts of a printing fluid cartridge.

The printing fluid cartridge receiving portion may be a plurality of printing fluid cartridge receiving portions each arranged to receive a respective printing fluid cartridge and to allow passage of printing fluid from a received printing fluid cartridge to printing fluid conduits of the ink jet printer. The data reader may be a plurality of data readers each arranged to read data indicating a quantity of fluid within a received cartridge from a respective electronic data storage device associated with a respective received printing fluid cartridge. The controller may be arranged to generate update data usable to modify data stored on each of said electronic data storage devices, and to modify data stored on each electronic storage device based upon said update data, such that data stored on each electronic data storage device indicates an updated quantity of fluid in a respective printing fluid cartridge.

The ink jet printer may be a continuous ink jet printer intended for industrial use. Such continuous ink jet printers have a variety of applications, including printing data such as "sell by" dates and the like onto packaging.

The invention further provides a fluid cartridge for an ink jet printer. The fluid cartridge comprises a vessel arranged to hold printing fluid and an electronic storage device configured to hold data indicating a quantity of printing fluid within said vessel, the electronic storage device being arranged to receive update data from an ink jet printer and to store data on said electronic data storage device based upon said update data such that said electronic data storage device indicates an updated quantity of fluid in said printing fluid cartridge.

The fluid cartridge may be intended for use in a printer of the type set out above, and accordingly features of the printer can similarly be applied to the fluid cartridge.

The invention also provides an electronic data storage device for use with a printing fluid cartridge of an inkjet printer, the electronic storage device being configured to hold data indicating a quantity of printing fluid within a fluid cartridge, the electronic storage device being arranged to receive update data from an ink jet printer and to store data on said electronic data storage device based upon said update data such that said electronic data storage device indicates an updated quantity of fluid in said printing fluid cartridge.

The electronic data storage device may be incorporated into a printing fluid cartridge of the type set out above, and such a printing fluid cartridge may be used in an ink jet printer of the type set out above. The electronic data storage device may be mounted on a circuit board. The circuit board may comprise a plurality of electrical contacts arranged to make contact with corresponding electrical contacts of an ink jet printer and a plurality of connections between said electronic data storage device and said electrical contacts.

Embodiments of the present invention will now be described, by way of example, with reference to the accompanying drawings, in which.

Figure 1:
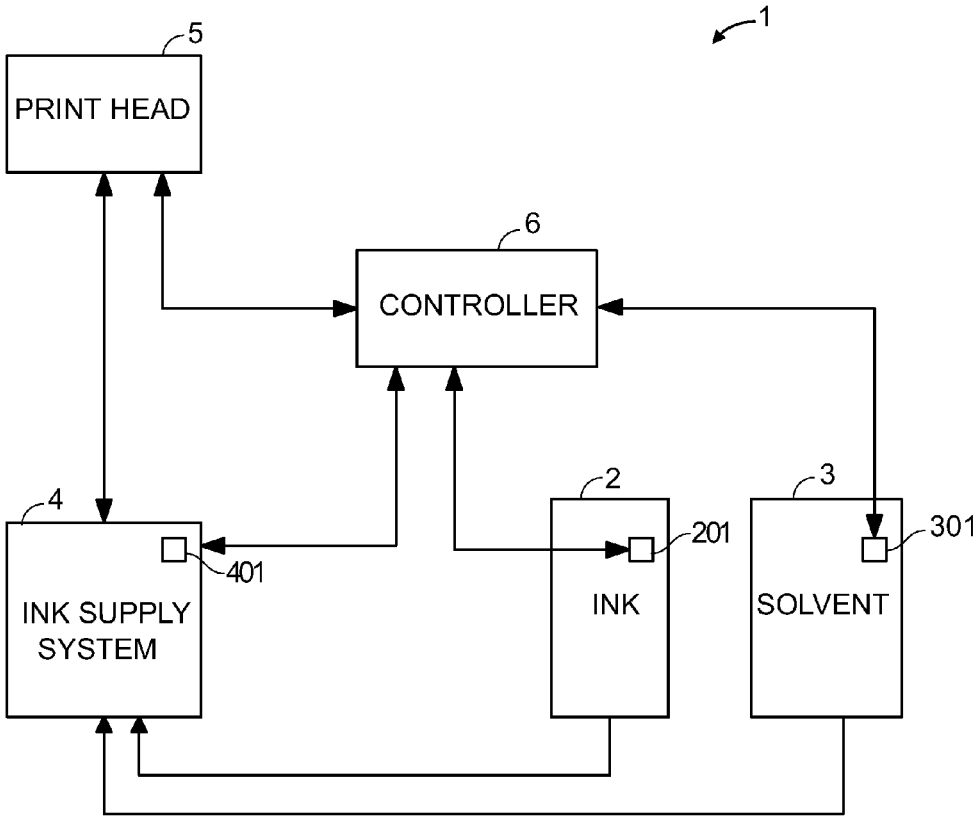
FIG. 1 is a schematic illustration of a continuous ink jet printer in accordance with an embodiment of the invention.

FIG. 1 schematically illustrates an inkjet printer 1, arranged to receive an ink cartridge 2 and a solvent cartridge 3. Ink from the ink cartridge 2 and solvent from the solvent cartridge 3 are mixed so as to generate printing ink of a desired viscosity which is suitable for use in printing. Ink is supplied from the ink cartridge 2 to an ink supply system 4, and solvent is provided from the solvent cartridge 3 to the ink supply system 4. The ink supply system is arranged to mix received ink and solvent so as to produce printing ink which is provided to a print head 5. The print head 5 generates a stream of ink droplets from the printing ink and each droplet of the stream of ink droplets is either directed to a substrate so as to cause print to be deposited on the substrate, or is recycled by being returned from the print head 5 to the ink supply system 4. As solvent tends to evaporate during the recycling process, it is usual to require further solvent to be added from the solvent cartridge 3 so as to provide printing ink of the desired viscosity.

The ink jet printer 1 is controlled by a controller 6, which provides appropriate control signals to the ink supply system 4 and the print head 5.

The ink cartridge 2 is provided with an electronic data storage device 201 storing data relating to contained ink as described in further detail below. Similarly, the solvent cartridge 3 is provided with an electronic data storage device 301 storing data relating to contained solvent as described in further detail below. The ink supply system 4 is also provided with an electronic data storage device 401 storing data relating to ink used within the ink supply system. The controller 6 is arranged to communicate with the electronic data storage devices 201, 301, 401.

When the ink supply system 4 is first used, data from the electronic data storage device 201 and or the electronic data storage device 301 is used to program the electronic data storage device 401 so as to indicate a type of ink being used. Subsequently, when a new ink cartridge or solvent cartridge is used within the printer, a check is made by the controller 6 of data stored on the electronic data storage device 401 and data stored on respective electronic data storage devices 201, 301 of the ink cartridge 2 and the solvent cartridge 3 to ensure compatibility. In this way, when the ink supply system is used with a particular type of ink, the controller 6 ensures that the printer is operable (i.e. ensures that ink is allowed to flow from the ink cartridge 2 and/or the solvent cartridge 3) only if data associated with the ink cartridge 2 and/or solvent cartridge 3 as stored on the electronic data storage devices 201, 301 indicates compatibility.

The ink jet printer 1, and particularly the ink supply system 4 is now described in further detail.

Figure 2:
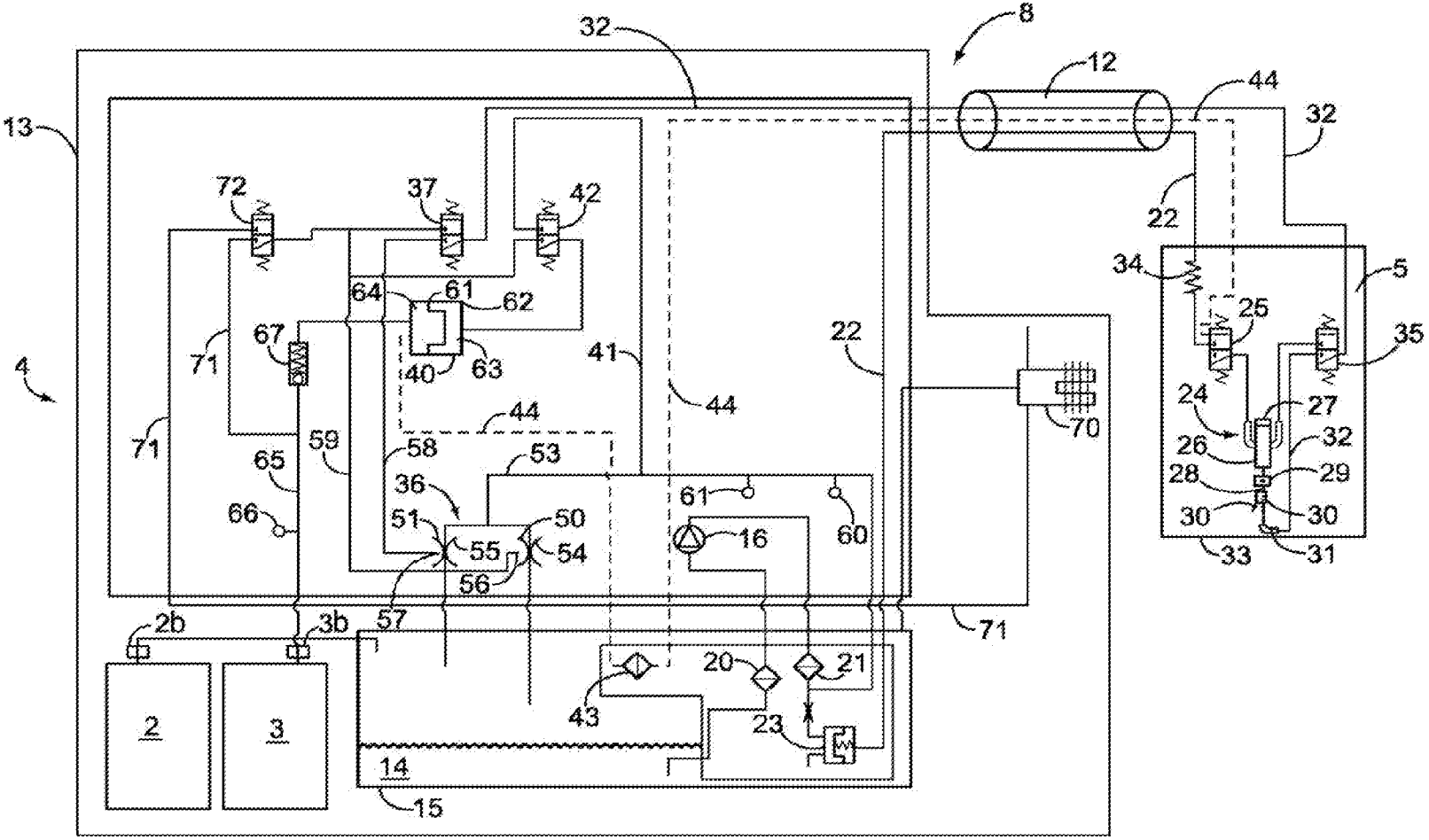
FIG. 2 is a schematic representation of the continuous ink jet printer of FIG. 1.
Figure 3A:
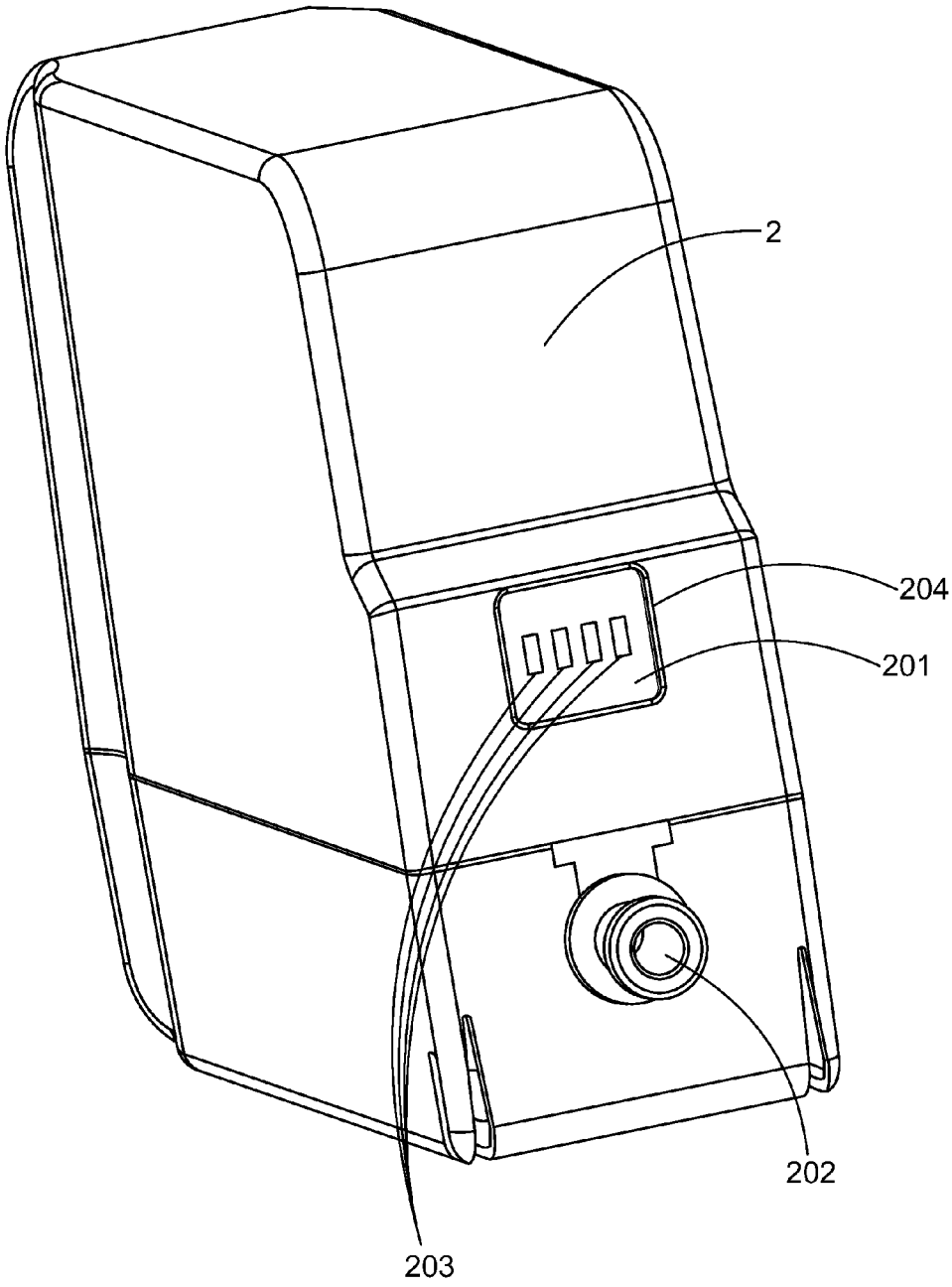
FIG. 3A is a perspective view of an ink cartridge used by the printer of FIGS. 1 and 2.

Referring now to FIG. 2 of the drawings, ink is delivered under pressure from the ink supply system 4 to the print head 5 and back via flexible tubes which are bundled together with other fluid tubes and electrical wires (not shown) into what is referred to in the art as an "umbilical" conduit 12. The ink supply system 4 is located in a cabinet 13 which is typically table mounted and the print head 5 is disposed outside of the cabinet. In operation, ink is drawn from a reservoir of ink 14 in a mixer tank 15 by a system pump 16, the tank 15 being topped up as necessary with ink and make-up solvent from the replaceable ink and solvent cartridges 2, 3. Ink is transferred under pressure from the ink cartridge 2 to the mixer tank 15 as required and solvent is drawn from the solvent cartridge 3 by suction pressure as will be described. The ink cartridge 2 takes a form illustrated in FIG. 3A. It can be seen that a nozzle 202 is provided through which ink flows from the ink cartridge 2. The electronic data storage device 201 comprises a plurality of contacts 203 which make contact with corresponding contacts provided by the printer 1. The ink cartridge 2 comprises a relatively hard outer casing which encases a relatively flexible inner vessel. Ink is contained within the inner vessel. The electronic storage device 201 is mounted on a circuit board placed between the relatively hard outer casing and relatively flexible inner vessel and is visible through a window 204 provided by the ink cartridge 2.

Figure 3B:
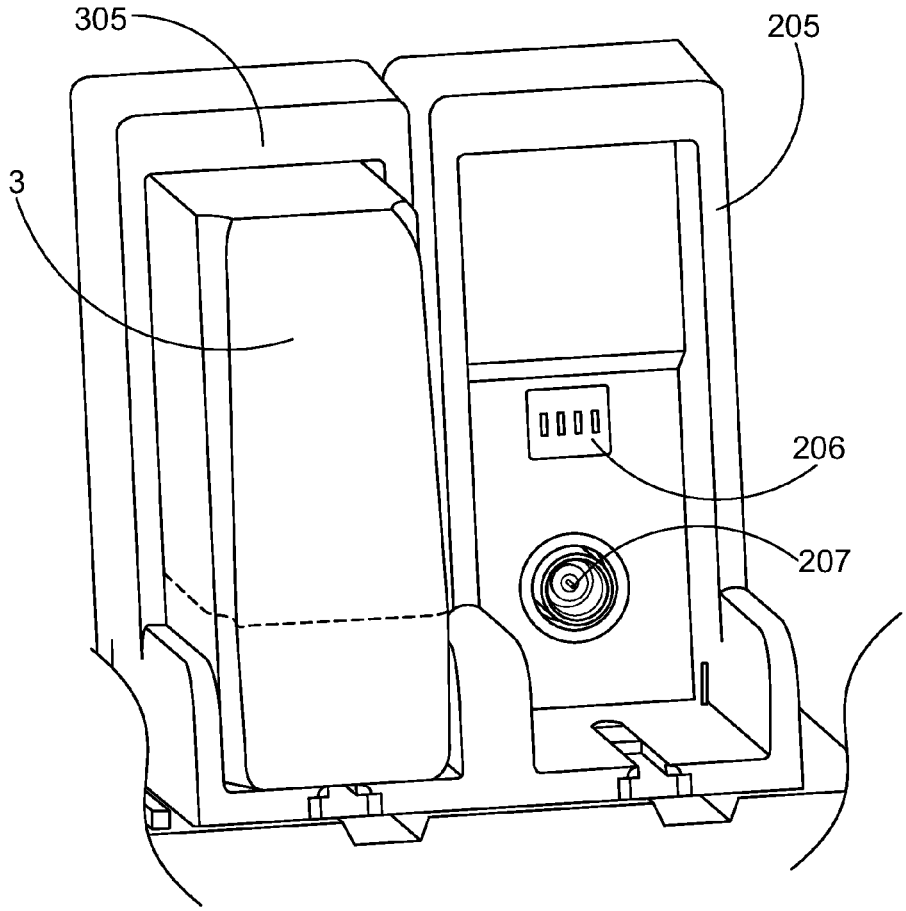
FIG. 3B is a perspective view of an ink cartridge receiving portion, and a solvent cartridge receiving portion in which a solvent cartridge has been inserted, provided by the printer of FIGS. 1 and 2.

FIG. 3B shows an ink cartridge receiving portion 205 in to which the ink cartridge 2 can be placed. It can be seen that the ink cartridge receiving portion 205 comprises corresponding contacts 206 arranged to contact with the contacts 203 of the electronic data storage device 201. Similarly, a needle 207 is arranged to enter the nozzle 202 of the ink cartridge 2 to allow ink to flow from the ink cartridge 2 into the printer 1.

FIG. 3B also shows the solvent cartridge 3. It can be seen that the solvent cartridge 3 is received in a solvent cartridge receiving portion 305 having the same general form as the ink cartridge receiving portion 205.

It will be understood from the description that follows that the ink supply system 4 and the print head 5 include a number of flow control valves which are of the same general type: a dual coil solenoid-operated two-way, two port flow control valve. The operation of each of the valves is governed by the controller 6 that also controls operation of the pumps. For example, ink is transferred from the ink cartridge 2 to the tank 15 through a valve 2*b*. Similarly, solvent is transferred from the solvent cartridge 3 to the tank 15 through a valve 3*b*. The valves 2*b*, 3*b* are controlled so as to control the addition of ink and solvent to the tank 15.

Referring back to FIG. 2, ink drawn from the tank 15 is filtered first by a coarse filter 20 upstream of the system pump 16 and then by a relatively fine main ink filter 21 downstream of the pump 16 before it is delivered to an ink feed line 22 to the print head 5. A fluid damper 23 of conventional configuration and disposed upstream of the main filter 21 removes pressure pulsations caused by the operation of the system pump 16.

At the print head 5 the ink from the feed line 22 is supplied to a drop generator 24 via a first flow control valve 25. The drop generator 24 comprises a nozzle 26 from which the pressurised ink is discharged and a piezoelectric oscillator 27 which creates pressure perturbations in the ink flow at a predetermined frequency and amplitude so as break up the ink stream into drops 28 of a regular size and spacing. The break up point is downstream of the nozzle 26 and coincides with a charge electrode 29 where a predetermined charge is applied to each drop 28. This charge determines the degree of deflection of the drop 28 as it passes a pair of deflection plates 30 between which a substantially constant electric field is maintained. Uncharged drops pass substantially undeflected to a gutter 31 from where they are recycled to the ink supply system 4 via return line 32. Charged drops are projected towards a substrate 33 that moves past the print head 5. The position at which each drop 28 impinges on the substrate 33 is determined by the amount of deflection of the drop and the speed of movement of the substrate. For example, if the substrate moves in a horizontal direction, the deflection of the drop determines its vertical position in the stroke of the character matrix.

In order to ensure effective operation of the drop generator 24 the temperature of the ink entering the print head 5 is maintained at a desired level by a heater 34 before it passes to the first control valve 25. In instances where the printer is started up from rest it is desirable to allow ink to bleed through the nozzle 26 without being projected toward the gutter 31 or substrate 33. The passage of the ink into the return line 32, whether it is the bleed flow or recycled unused ink captured by the gutter 31, is controlled by a second flow control valve 35. The returning ink is drawn back to the mixer tank 15 by a jet pump arrangement 36 and a third flow control valve 37 in the ink supply system 4.

As ink flows through the system and comes into contact with air in the tank 15 and at the print head 5, a portion of its solvent content tends to evaporate. The ink supply system 4 is therefore also designed to supply make-up solvent as required so as to maintain the viscosity of the ink within a predefined range suitable for use. Such solvent, provided from the cartridge 3, is also used to flush the print head 5 at appropriate times in order to keep it clear of blockages. The flush solvent is drawn through the ink supply system 4 by a flush pump valve 40 that is driven by a flow of ink in a branch conduit 41 under the control of a fourth flow control valve 42 as will be described below. The flush solvent is pumped out via a filter 43 through a flush line 44 (represented in dotted line in FIG. 2) that extends from the ink supply system 4 through the umbilical conduit 12 to the first flow control valve 25 in the print head 5. After passing through the nozzle 26 and into the gutter 31 the solvent is drawn into the return line 32 via the second control valve 35 and to the third control valve 37. The returning solvent flows under suction pressure from the jet pump arrangement 36.

The jet pump arrangement 36 comprises a pair of parallel venturi pumps 50, 51 that are supplied by pressurised ink from a branch line 53 from the outlet of the main filter 21. The pumps are of known configuration and make use of the Bernoulli Principle whereby fluid flowing through a restriction in a conduit increases to a high velocity jet at the restriction and creates a low pressure area. If a side port is provided at the restriction this low pressure can be used to draw in and entrain a second fluid in a conduit connected to the side port. In this instance, the pressurised ink flows through a pair of conduits 54, 55 and back to the mixer tank 15, each conduit 54, 55 having a side port 56, 57 at the venturi restriction. The increase in flow velocity of the ink creates a suction pressure at the side port 56, 57 and this serves to draw returning ink and/or solvent through lines 58, 59 when the third flow control valve 37 is open. The flow control valve 37 is operated such that the flow of returning ink/solvent to each venturi pump 50, 51 can be separately controlled. More specifically, the control system determines whether to allow flow through one or both venturi pumps 50, 51 depending on the temperature of the ink determined by a temperature sensor 60 in the branch line 53. If the ink has a relatively low temperature it will have a relatively high viscosity and therefore greater pumping power is required to draw ink back from the gutter 31 in which case both pumps 50, 51 should be operated. In the event that the ink has a relatively high temperature it will have a relatively low viscosity in which case the only one pump 50 is required to generate sufficient suction. Indeed operation of both the pumps should be avoided in the latter circumstance, as there would be a risk of air getting into the supply system, which serves to cause excess evaporation of the solvent, and therefore increased consumption of make-up solvent.

The branch line 53 is connected to line 41 that conveys ink to the flush pump valve 40 via the fourth flow control valve 42. When the control valve 42 is appropriately operated by the controller 6 in order to effect flushing of the print head 5 it allows the flush pump valve 40 to be pressurised by the ink from line 41. The valve 40 is rolling diaphragm type in which a resilient "top-hat" diaphragm 61 divides a valve housing 62 into first and second variable volume chambers 63, 64. Ink is supplied under pressure to the first chamber 63 and make up solvent is delivered from the solvent cartridge 3 through a solvent supply line 65 to the second chamber 64 via a pressure transducer 66 and a non-return valve 67. The higher pressure of the ink entering the first chamber 63 relative to the solvent serves to deflect the diaphragm 61 from its normal position as shown in FIG. 2, to a position where the volume of the first chamber 63 has increased at the expense of the volume of the second chamber 64 and solvent is forced out of the second chamber 64 and towards the print head 5 via the flush line 44. It is to be appreciated that other flush pump designs may be used to achieve the same operation.

In use, the atmosphere above the mixer tank 15 soon becomes saturated with solvent and this is drawn into a condenser unit 70 where it is condensed and allowed to drain back into a solvent return line 71 via a fifth control valve 72 of the ink supply system.

Figure 4A:
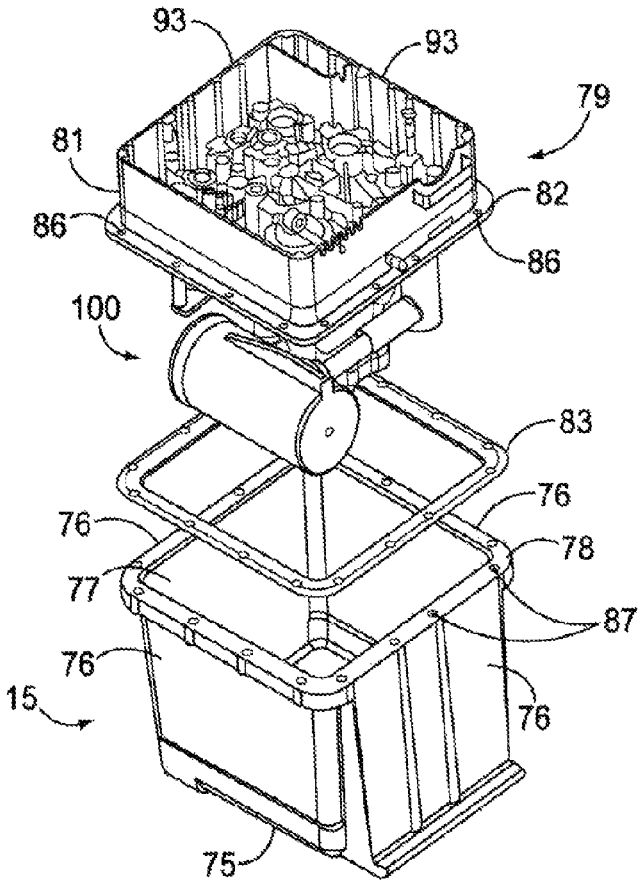
FIG. 4A is an exploded perspective view from above of part of the ink supply system of FIG. 2.
Figure 4C:
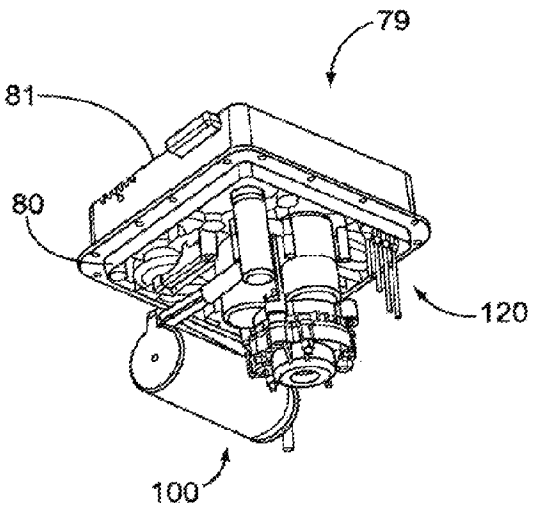
FIG. 4C is a perspective view from below of the ink supply system of FIGS. 2, 4A and 4B in a partially assembled condition.
Figure 4B:
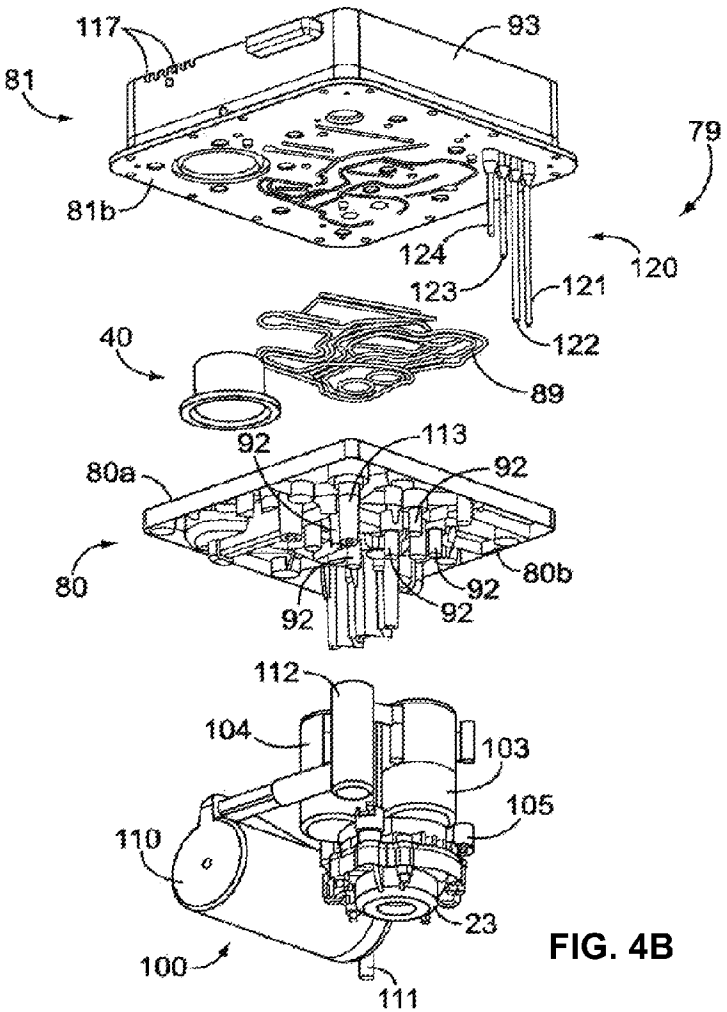
FIG. 4B is a further exploded perspective view of part of the ink supply system of the printer of FIG. 2.

The ink supply system 4, represented in circuit form in FIG. 2, is physically embodied as a modular unit that is illustrated in FIGS. 4A to 4C. The mixer tank 15 comprises a reservoir with a base wall 75, upstanding sidewalls 76 and an open top that defines a mouth 77. The side walls 76 terminate at their upper edge in a peripheral flange 78 around the mouth 77 and provide support for a manifold block 79, which provides fluid flow conduits between components of the ink supply system, many of which are conveniently supported on the block 79.

The manifold block 79 comprises two vertically stacked, interconnected parts: a tank-side feed plate 80 that supports a number of components over the ink in the tank 15 and an upper manifold plate 81 on which further components are supported. The plates 80, 81, which are shown in detail in FIGS. 5A to 5C and 6A to 6C, are generally square in outline, with the tank-side feed plate 80 being slightly smaller such that it fits inside the mouth 77 when the peripheral edge 82 of the manifold plate 81 rests on the flange 78 around the tank mouth 77. A seal 83 is provided between the flange 78 and the edge 82 of the manifold plate 81. Each of the plates 80, 81 has an upper and a lower surface 80*a*, 80*b* and 81*a*, 81*b*, and the stacked arrangement is such that the lower surface 81*b* of the manifold plate overlies, and is in interfacing abutment with the upper surface 80*a* of the feed plate 80.

Figure 5A:
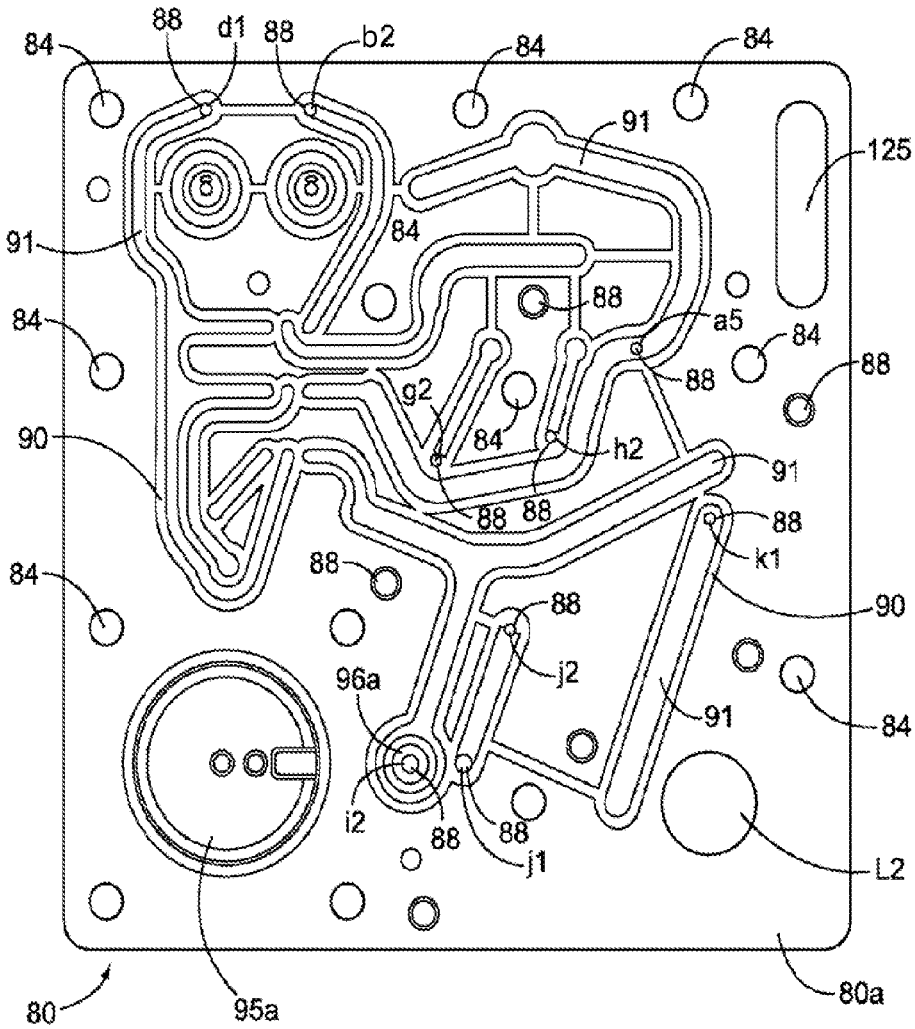
FIG. 5A is a plan view of an upper surface of a feed plate of the ink supply system of FIGS. 4A and 4B.
Figure 5C:
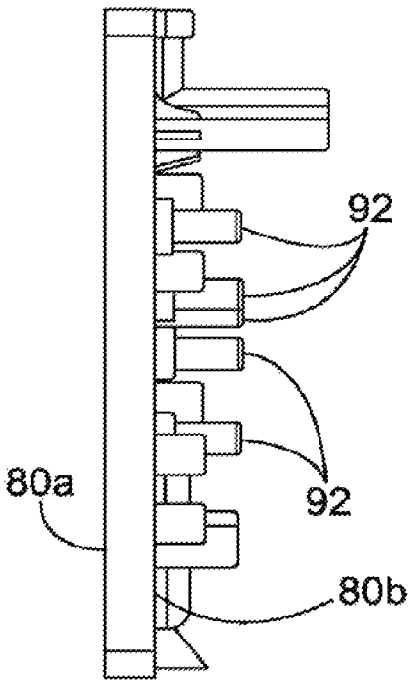
FIG. 5C is a side view of the feed plate in the direction of arrow A of FIG. 5B.
Figure 5B:
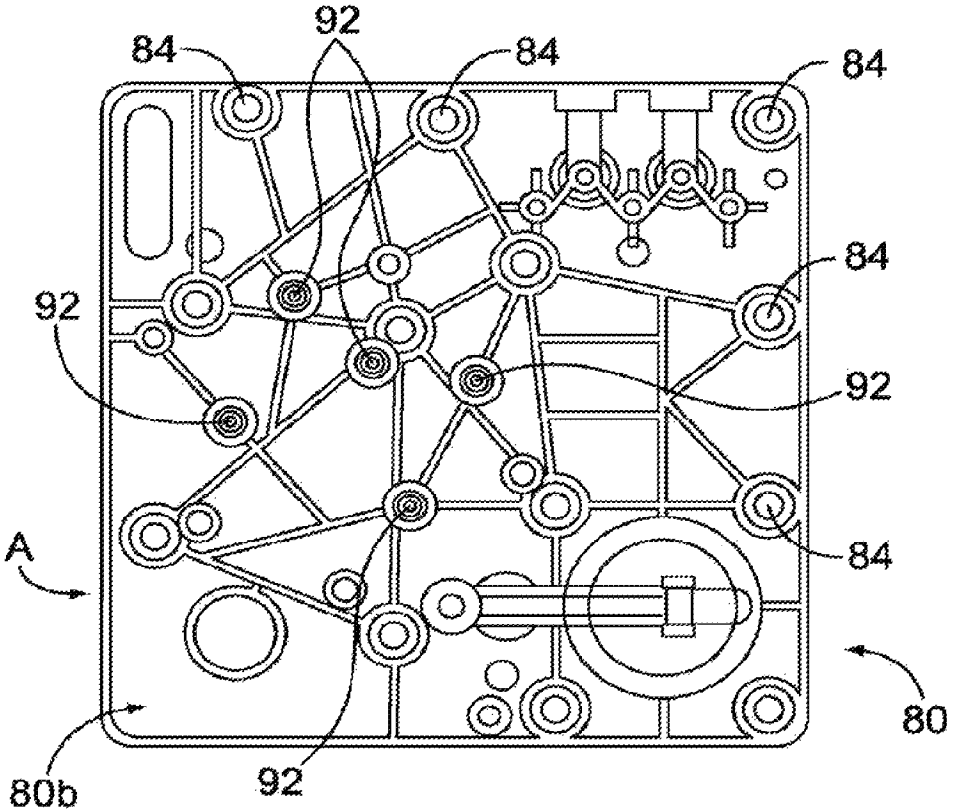
FIG. 5B is a plan view of a lower surface of the feed plate of FIG. 5A, with components removed for clarity.
Figure 6A:
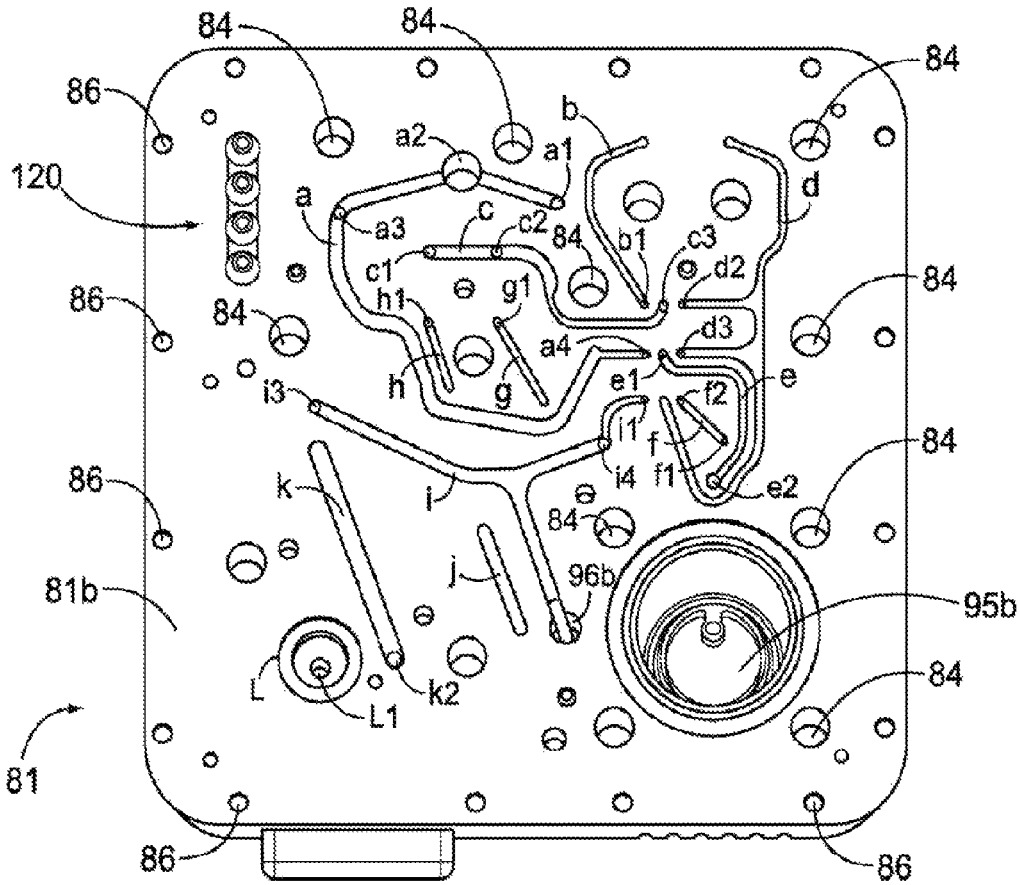
FIG. 6A is a plan view of a lower surface of a manifold plate of the ink supply system of FIGS. 4A and 4B.

The plates 80, 81 are penetrated in a direction substantially perpendicular to the plane of the interfacing surfaces 80*a*, 81*b* by a number of aligned fixing apertures 84 for fixing screws (not shown) that are used to connect the plates together. The manifold plate 81 additionally has a plurality of apertures 86 spaced about its periphery for location over upstanding pegs 87 on the flange 78 of the tank 15, and a plurality of ports 88 for connection to components of the ink supply system 4. The flow of ink between the ports 88, and therefore the components of the ink supply system, is provided by a plurality of discrete channels A to K defined in the lower surface 81*b* of the manifold plate 81. The channels A-K interconnect the ports 88 in a predetermined relationship as can be seen in FIGS. 5A and 6A. When the interfacing surfaces 80*a*, 81*b* of the plates 80, 81 are brought together the channels A-K are covered by the upper surface 80*a* of the feed plate 80 and sealed by a sealing member 89 that is received in a pattern of recesses 90 defined in that surface 80*a*. The sealing member 89 is made from a moulded elastomeric material such as synthetic rubber of the kind used in O-ring seals and is compressed in the recesses when the plates 80, 81 are fastened together. It is configured such that it comprises a plurality of ring seals, each designed to seal around a particular channel when the plates 80, 81 are brought together, the seals being interconnected to form one member for convenience. The sealing member 89 demarcates selected areas 91 of the upper surface 80*a* that generally correspond to the pattern of channels A-K defined on the manifold plate 81, these areas 91 serving to close the channels A-K whilst the sealing member 89 seals the channels A-K against leakage. Some of the areas 91 bounded by the sealing member 89 contain the ports 88 that allow fluid communication between the channels A-K and the components mounted on the feed plate 80. A plurality of spigots 92 extend substantially perpendicularly from the ports 88 on the lower surface 80*b* feed plate 80 and provide for easy connection of the components to said ports 88.

The upper surface 81*a* of the manifold plate 81 has upstanding side walls 93 spaced inwardly of the peripheral apertures 86, the area inside the walls 93 being configured to support components of the ink supply system 4.

The arrangement of the channels A-K in the manifold plate 81 is shown clearly in FIG. 6A, with the sealing recesses 90 and channel closure areas 91 being shown on the feed plate 80 in FIG. 5A. The relationship of the channels A-K to the flow lines and conduits of the ink system 4 of FIG. 2 is summarised below.

Channel A defines the branch line 53 and connected line 41 for pressurised ink that extend from the outlet of the main filter 21, which is connected to port A5 on the feed plate 80, to the jet pump 36 inlet that is connected to port A1. Line 41 is connected to the fourth control valve 42 (which controls activation of the flush pump) via port A4. The pressure transducer 61 is in fluid communication with the conduit via port A3 and a temperature sensor 60 via port A2.

Channel B interconnects the second venturi jet pump 51 and the third control valve 37 which allows the flow to pump 51 be switch on and off. Port B1 in the manifold plate 81 is connected to the valve 37 and port B2 in the feed plate 80 connects to the venturi pump 51.

Channel C defines part of the ink return line 32 from the print head 11 and interconnects the return line (port C2) in the umbilical conduit 12 from the print head 11 to the third control valve 37 (port C3). Port C1 is not used.

Channel D defines the conduit that carries the flow of ink returning from the first chamber 63 of the flush pump 40 (via the fourth control valve 42) to the first venturi pump 50 of the jet pump arrangement 36 and/or the recovered solvent from the condenser unit 70. Port D1 on the feed plate 80 connects to port of the first venturi pump 50, port D2 on the manifold plate 81 to an outlet of the third control valve 37, port D3 to the fourth control valve 42 and port D4 to the fifth control valve 72 (controlling the flow of recovered solvent from the condenser unit 70).

Channel E defines the conduit 41 that delivers pressurised ink to the flush pump valve 40 and interconnects an outlet of the fourth control valve 42 (port E1 in the manifold plate) to the inlet (port E2 in the manifold plate) of the first chamber 63 of the flush pump valve 40.

Channel F defines part of the solvent return line 71 from the condenser unit 70 and interconnects the condenser drain (port F1 in the manifold plate 81) to the fifth control valve 72 (at port F2 in the manifold plate 81).

Channel G defines part of the solvent flush line 44 and interconnects that to the flush line tube in the umbilical conduit 12 to the print head 5 (port G1 on the manifold plate 81) and an outlet of the solvent flush filter 43 (port G2 on the feed plate 80).

Channel H defines part of the ink feed line 22 and interconnects the outlet of the damper 23 (port H2 in the feed plate 80) and ink feed line tube in the umbilical conduit 12.

Channel I defines the solvent supply line 65 from the solvent cartridge 18 and interconnects the end of a conduit from the cartridge 18 (that end being connected to port I4 in the manifold plate 81) to the fifth control valve 72 (port I1 in the manifold plate 81). It also provides fluid communication with the non-return valve 67 (port I2 in the feed plate 81) and the pressure transducer 66 (port I3).

Channel J defines the solvent flow conduit between the non-return valve 67 and the flush pump 40. Port J1 in the feed plate 80 provides fluid communication between the inlet to the second chamber 64 of the flush pump 40 and port J2, also in the feed plate 80, with an outlet of the non-return valve 67.

Channel K defines part of the main ink feed line 22 and extends between the outlet of the system pump 16 (port K2 on the manifold plate 81) and the inlet of the main filter 21 (port K1 on the feed plate 80).

Ports L1 on the manifold plate 81 and L2 on the feed plate 80 simply allow a direct connection between the outlet of the coarse filter 20 and the inlet of the system pump 16 without any intermediate flow channel.

Figure 7A:
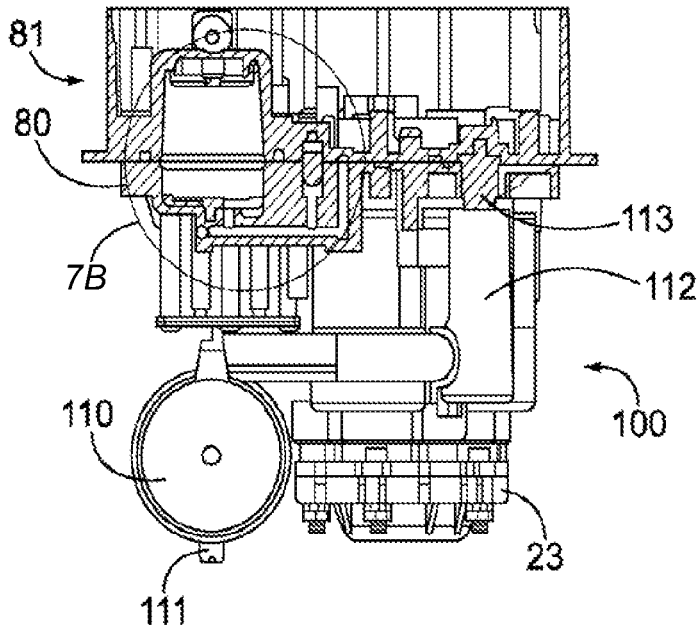
FIG. 7A is a partially sectioned side view of part of the ink supply system of FIGS. 2, 4A and 4B.
Figure 7B:
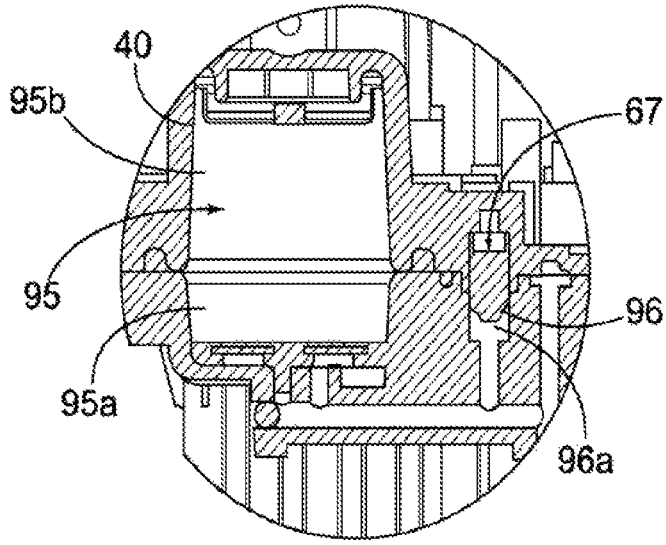
FIG. 7B is an enlarged view of the encircled part labelled X in FIG. 7A.
Figure 8A:
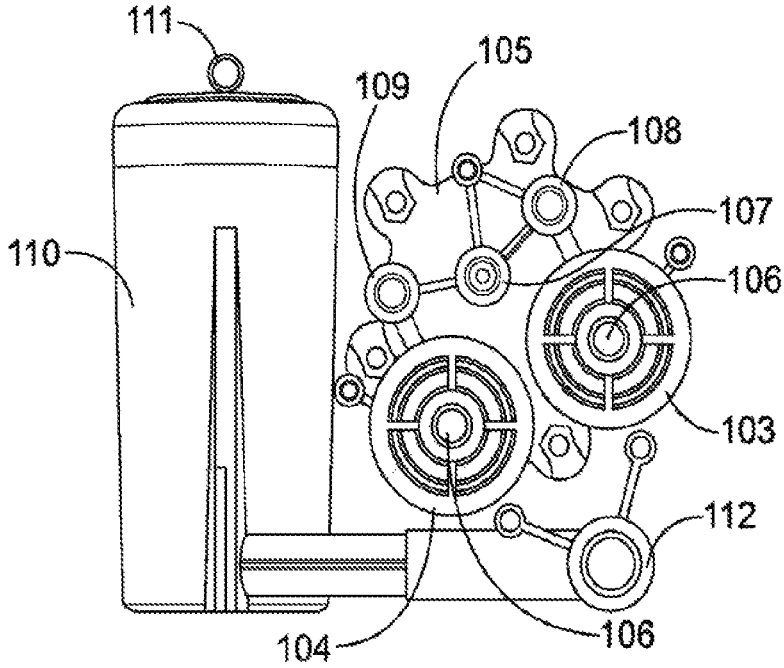
FIGS. 8A and 8B are end views of part of a filter module of the ink supply system.
Figure 8B:
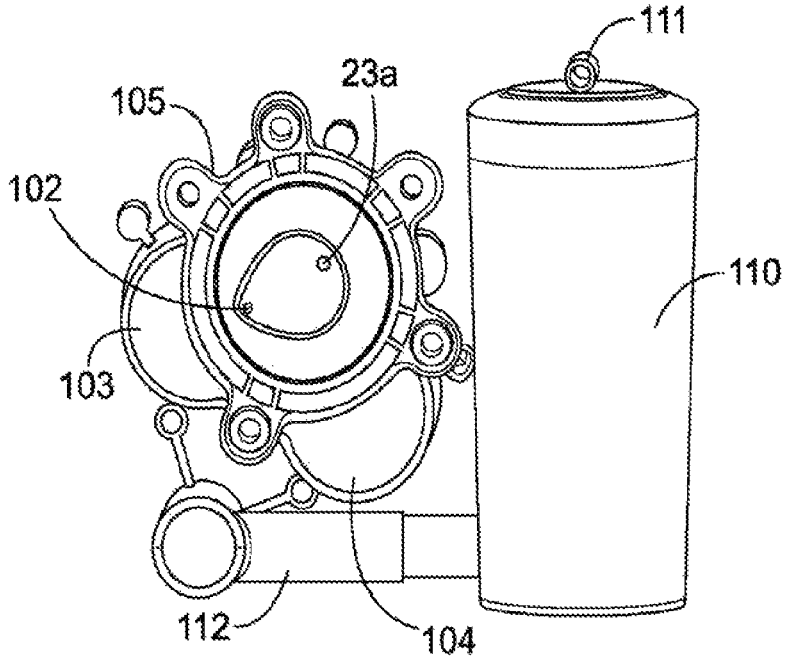
Figure 9A:
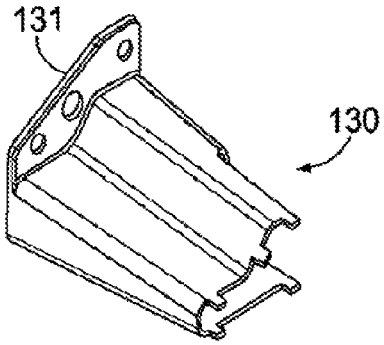
FIGS. 9A to 9D are respective perspective, side, side sectioned (along line B-B of FIG. 9D) and underneath plan views of the guard of FIG. 6C.
Figure 9B:
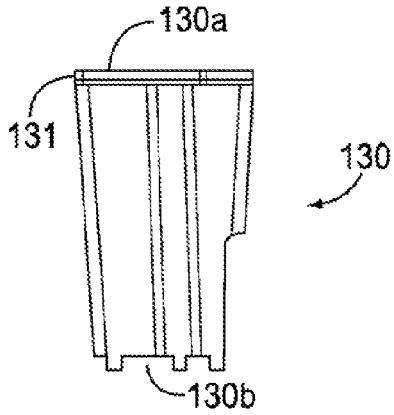
Figure 9C:
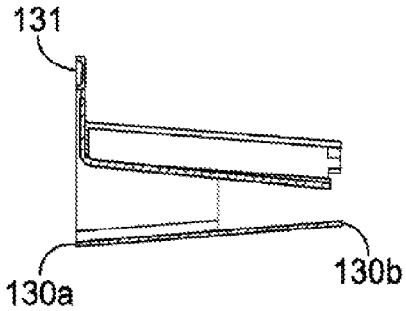
Figure 9D:
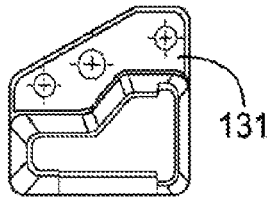

Each of the interfacing surfaces 80*a*, 81*b* of the plates 80, 81 has a large cylindrical recess 95*a*, 95*b* which combine when the plates are brought together, so as to form a chamber 95 for housing the flush pump 40, as best seen in FIGS. 7A and 7B. Similarly, the non-return valve 67 sits in a small chamber 96 defined between recesses 96*a*, 96*b*.

Referring back to FIGS. 4A and 4B, the modular nature of the ink supply system 4 will now be more clearly appreciated. The manifold block 79 configuration allows the various ink supply system components to be plugged simply into fluid communication with the ports 88 (or the spigots extending from the ports) and therefore the fluid flow channels in a modular fashion.

Some of the ink supply system components supported on the manifold block 79 will now be described with reference to FIGS. 4 to 9. An integrated filter and damper module 100 is connected to the lower surface 80*b* of the feed plate 80 by five spigots 92 as shown in FIGS. 4B and 4C. Two of the spigots are for mounting purposes only whereas the other spigots 92 extend rearwardly from ports K1, G2 and H2 in the plate. The module, shown separately in FIGS. 8A and 8B comprises a pair of cylindrical housings 103, 104 that are integrally formed with a mounting support 105 for the damper 23 (not shown in FIGS. 8A and 8B but shown in FIGS. 4B, 4C and 7A). A first housing 103 contains the main ink filter 21 and the second housing 104 houses the solvent filter 43. Each of the cylindrical housings 103, 104 has a central inlet opening 106 that fits over a respective spigot 92 in a friction fit, the opening for the main ink filter 21 connecting to the spigot at port K1 and the opening for the solvent filter 43 connecting to the spigot at port J2. A suitable sealing ring may be provided between each spigot 92 and inlet opening 106. The filtered ink egresses from the housing 103 at aperture 102, passes through the mounting support 105 to an inlet of the damper 23 and exits the damper and support 105 at aperture 23*a* to an integrally formed outlet conduit 107 that extends substantially parallel to the axis of the cylindrical housing 103, 104 and connects to the spigot 92 at port H2. A further conduit 108 extends from a side opening in the ink filter housing 103 and connects to the spigot 92 at port A5 from where the ink flows into the branch line 53 defined by channel A. The filtered solvent passes through a side aperture in the housing into a conduit 109 that connects to the spigot 92 at port G2 from where it flows into the flush line 44 defined by channel G.

It will be seen that the inlets 106 and the outlet conduits 107, 108, 109 are disposed substantially in parallel so that the module can be plugged into the manifold block with relative ease, with the inlets and conduits sliding on to the respective spigots 92.

The filter and damper module 100 also comprises the coarse filter 21 in a further cylindrical housing 110 whose inlet has a take up pipe 111 for connection to a tube 111 that extends into the ink 14 at the bottom of the mixer tank 15. In operation, the system pump 16 (upstream of the coarse filter 21) operates to draw ink from the tank 15 through the take up pipe 111 and into the coarse filter 21. The outlet of the coarse filter 21 directs filtered ink along an integral right-angled outlet conduit 112 that connects to port L1 in the manifold plate from where ink flows to an inlet pipe 113 (FIGS. 6C and 7A) of the system pump 16, which extends through ports L2 and L1 and into the end of the filter outlet conduit 112.

Several components of the ink supply system 4 are mounted on the upper surface 81*a* of the manifold plate 81, these include in particular the jet pump assembly 36, system pump 16, the third to fifth flow control valves 37, 42, 72, temperature sensor 60, pressure transducer 61, and a circuit board 115 for terminating electrical wiring connecting the valves, pumps and transducers to the control system. Many of these components are hidden from view in FIG. 6B by the circuit board 115.

The three flow lines 22, 32, 44 are partly defined by respective tubes in the umbilical conduit 12 as described above and these connect to the respect ports H1, C2, G1 that are conveniently grouped together at a connection block 116 (FIG. 6B) defined on the upper surface 81*a* of the manifold plate 81. The tubes are supported in cut-out notches 117 (FIG. 4B) in the side wall 93.

Figure 6C:
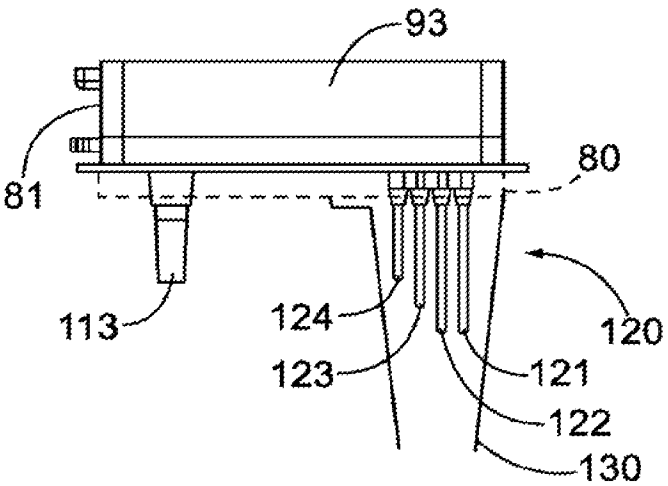
FIG. 6C is a side view of the manifold plate in the direction of arrow A of FIG. 6B, with components removed for clarity, the feed plate being shown in dotted line and an ink level sensor guard being shown in section.
Figure 6B:
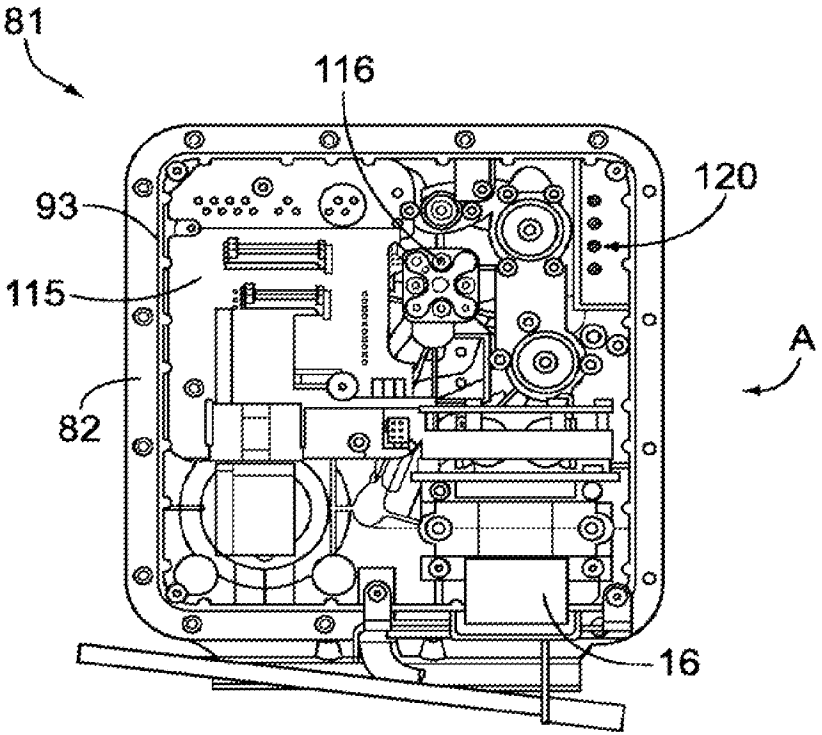
FIG. 6B is a plan view of an upper surface of the manifold plate of FIG. 6A when fitted with components.

An ink level sensor device 120 shown in FIGS. 4B, 4C, and 6C is provided on the manifold block 79 in order to detect the level of ink in the mixer tank at any given time. It comprises four electrically conductive pins 121, 122, 123, 124 that depend from the lower surface 81*b* of the manifold plate 81. They extend through a slot 125 in the feed plate 80 and into the tank 15 where they are designed to dip into the ink 14. The first and second pins 121, 122 are of the same length; a third 123 of intermediate length and the fourth 124 has the shortest length. The pins are connected to one or more electrical sensors (e.g. current or a capacitance sensors) and an associated electrical circuit 115 mounted on the upper surface 81*a* of the manifold plate 81. The sensor 120 is designed to sense the presence of the electrically conductive ink when it completes an electrical circuit between the first pin 121 and one or more of the other pins 122, 123, 124. For example, when the level of ink in the tank is relatively high the ends of all of the pins 121-124 will be immersed in the ink and the sensor(s) detects that all the circuits are complete. On the other hand when the level of ink is relatively low only the longer first and second pins 121, 122 are immersed in ink and therefore a circuit is completed only between those two. A signal indicative of the measured level of ink is sent to the controller 6, which can then take a decision on whether more ink should be delivered into the tank 15. It is to be appreciated that other forms of ink level sensing devices may be used to the same effect.

In operation, ink and solvent returning into the tank from the return line 32 may cause turbulence, particularly at the surface of the ink 14, such that foam of bubbles is formed on the surface of the ink owing to surfactants present in the ink. It is known to use a deflector plate at the outlet of the return line to reduce the turbulence caused by the returning ink/solvent but this does not always eliminate foam entirely. The presence of the foam can mask the real level of ink in the tank and lead to erroneous readings by the level sensor 120. In order to counteract interference with the correct operation of the level sensor 120, a guard 130 is connected to the lower surface 80*b* of the feed plate 80 and depends downwards into the tank 15 such that it shields the pins 120-124 from any surface foam generated by incoming ink or solvent. This is illustrated in FIG. 6C. The guard 130, shown in detail in FIGS. 9A-D, comprises a continuous thin wall made from, for example, a porous polypropylene material that has an upper end 130*a* with an integral laterally extending flange 131 for connecting to the feed plate 80 and a lower end 132 that, in use, is proximate to the base wall 75 of the tank 15. The wall tapers inwardly between its upper and lower end 130*a*, 130*b* and surrounds the pins 120-124 such that the ink within its confines is maintained substantially free of foam and a correct level reading can therefore be determined. It will be appreciated that the guard 130 may be used with any form of level sensor that depends upon immersion within the ink in the tank 15 and that the wall may be manufactured from any suitable material, porous or otherwise.

The configuration of the manifold block and in particular the channels defined at the interface between the manifold plate and the feed plate obviates the need for many pipe, tubes, hoses or the like that interconnect the components of the ink supply system. The arrangement is thus much simpler to assemble thus reducing the time associated with building the system and the likelihood of errors occurring. In general, the area inside the cabinet is much tidier such that it is easier to access individual components. The manifold block also eliminates connectors associated with such pipes, which are potential sources of leaks. The reliability of the system is therefore improved thus reducing servicing requirements.

The general structure of the manifold block provides for a compact arrangement.

The general arrangement of the ink supply system 4 allows the ink supply system 4 to act as an easily exchangeable component of the printer 1. The electronic data storage device 401 allows data relating to the ink supply system 4 to be stored and read by the printer 1.

It has been explained above that the ink cartridge 2 has an associated electronic data storage device 201 storing data related to ink in the ink cartridge 2. The nature of this data is now described with reference to FIG. 10.

The stored data comprises read only data 210 and sequential write data 211. The read only data comprises serial number data uniquely identifying the electronic storage device 201 which is suitably stored in Read Only Memory (ROM). Ink reference data 213 comprises 6 bytes of ASCII code representing 5 alpha-numeric characters which provide a reference for the ink contained within the ink cartridge 2. Fluid type data 215 comprises two bytes of data indicating a fluid type value. A Fluid Type value indicates a type of solvent that an ink is based upon. For example, the solvent base of an ink may be MEK, Ethanol or water. The fluid type which is used is determined by factors such as the substrate to be printed on and other factors such as environmental considerations. Within each solvent family there are several different inks which are formulated to meet other application requirements. These could include the colour of the ink, how the dried ink adheres to a particular material, etc. Each of these inks has unique ink reference data 213.

The read only data 210 further comprises various data indicating parameters of the ink contained within the ink cartridge 2. Specifically, the read only data 210 comprises time of flight data 214 indicating a time of flight for ink contained within the ink cartridge 2 and target pressure data 216 indicating the correct pressure at which the printer should be operated for ink within the ink cartridge 2. Temperature data 217 indicates a temperature to which the ink should be heated for use.

Batch code data 218 is allocated during production of the cartridge 2 and indicates a batch in which the ink cartridge 2 was produced. Expiry date data 219 indicates a date by which the ink cartridge 2 should be used.

The electronic data storage device 201 also stores data which can be updated by the printer 1, in the form of the sequential write data 211. Specifically, fluid level data 220 indicates the current level of fluid within the cartridge 2, insertion data 221 indicates the number of times which the cartridge has been inserted into a printer, and run hours data 222 indicates a number of hours for which the ink cartridge has been used.

The electronic data storage device 201 can take any suitable form. In a preferred embodiment of the invention the electronic data storage device is a Maxim-DS2431 1024 bit 1-wire EEPROM, although other suitable devices can be used.

The sequential write data 211 is processed as follows. Each of the fluid level data 220, the insertion data 221 and the run hours data 222 is allocated a respective area of memory on the EEPROM in which all bits are initiated to a common state. Considering the fluid level data 220 as an example, as ink is removed from the ink cartridge 2, and this is determined by the printer 1 in the manner described below, bits of the allocated memory are changed to the other state. That is, the fluid level data 220 may initially comprise 1 byte of data in which all bits are set to a state of "1". When it is determined that one eighth of the ink within the cartridge has been used, one bit is set to a state of "0". When it is determined that one quarter of the ink within the cartridge 2 has been used, a further bit is set to a state of "0". In this way, the fluid level data 220 can be read by the printer and depending upon the number of bits which have been set to a state of "0" the quantity of ink within the cartridge can be determined.

The insertions data 221 and the run hours data 222 can also be suitably implemented in the manner described above with reference to the fluid level data 220. The insertion data 221 and the run hours data 222 can be used by the controller 6 to ensure that the ink cartridge 2 is not used more than a predetermined number of times or for more than a predetermined period, so as to minimise the risk of component failure.

The electronic data storage device 301 associated with the solvent cartridge 3 stores data which is generally similar to that described with reference to FIG. 10. It should however be noted that in a preferred embodiment of the invention fluid type data is not stored on the electronic data storage device 301, the solvent type instead being provided by solvent reference data corresponding to the ink reference data 213.

Figure 10:
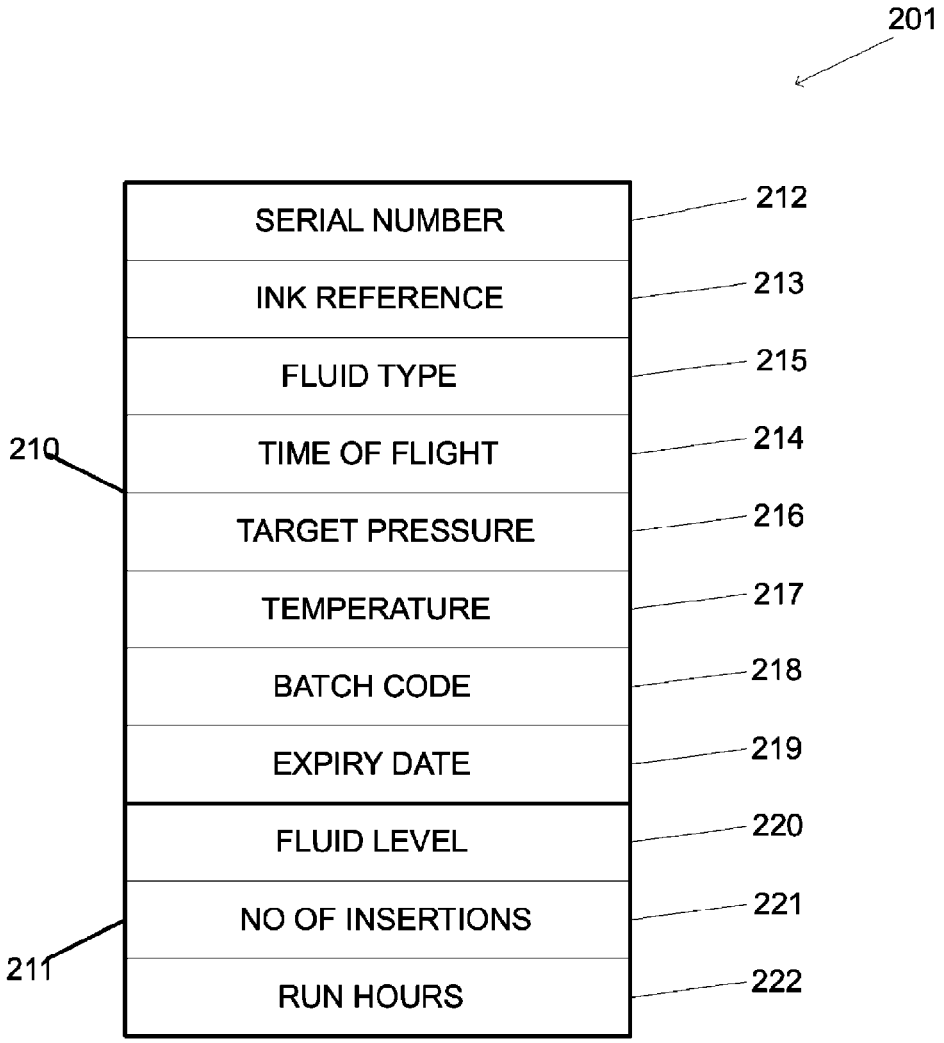
FIG. 10 is a schematic illustration of data stored on an electronic data storage device associated with the ink cartridge of FIG. 3A.
Figure 11:
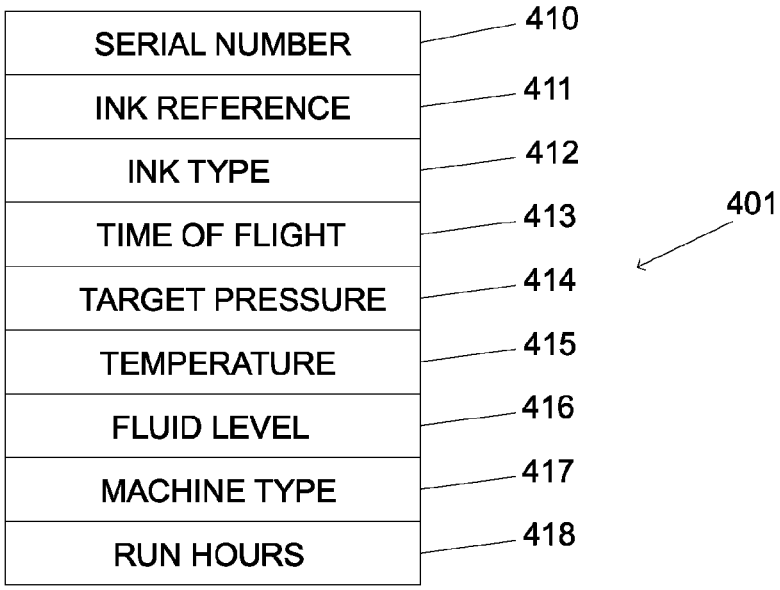
FIG. 11 is a schematic illustration of data stored in an electronic data storage device associated with the ink supply system of FIG. 4A.

FIG. 11 shows data stored on the electronic data storage device 401 associated with the ink supply system 4. It can be seen that serial number data 410 is stored (suitably in ROM) providing an identifier for the ink supply system 4. Various data indicative of an ink within the ink supply system 4 is also stored. As mentioned above, data indicating a type of ink is written to the electronic data storage device 401 when the ink supply system 4 is first used so as to associate the ink supply system 4 with a particular type of ink and in this way to prevent an ink supply system which has been used with one type of ink from later being used with an incompatible ink. Ink reference data 411 indicates a reference number for an ink used in the ink supply system 4. Ink type data 412 indicates an ink type. Various data indicating parameters of ink within the ink supply system is also stored. Specifically, time of flight data 413, target pressure data 414 and temperature data 415 are all stored on the electronic storage device 401 and respectively correspond to the time of flight data 215, target pressure data 216, and temperature data 217 described with reference to the electronic data storage device 201 in FIG. 10.

Fluid level data 416 indicates a level of fluid within the reservoir 14 of the ink tank 15 of the ink supply system 4. This fluid level data 416 is derived from the output of the ink level sensor device 120 described above with reference to FIGS. 4B, 4C and 6C. Machine type data 417 indicates a type of printer in which the ink supply system 4 is intended to be used. Run hours data 418 indicates the number of hours for which the ink supply system 4 has been used. The serial number 410 and machine type data 417 are preferably implemented as read only data. That is, the printer 1 is preferably inhibited from amending this data. Data relating to the type of ink used by the ink supply system 4, that is the ink reference data 411 and ink type data 412 is preferably implemented as write once data. That is, while the printer 1 should be able to update this data when the ink supply system 4 is used for the first time based upon the inserted ink cartridge 2 it should not be possible for this data to be subsequently changed during operation.

The fluid level data 416 is writable by the printer 1 so as to be updated as the level of the reservoir 14 in the ink tank 15 varies.

The run hours data 418 is preferably implemented as sequential write data as described above with reference to the fluid level data 222 of FIG. 10.

It was indicated with reference to FIG. 11 that machine type data 417 indicated a type of printer with which the ink supply system 4 was intended for use. In a preferred embodiment of the invention, the printer 1 has an associated electronic storage device storing various data relevant to the printer. This data can be used to determine whether the machine type data 417 of the data storage device 401 indicates that the ink supply system is suitable for use in a particular printer. That is, where differing printer types are provided, differing ink supply systems can also be provided, and data stored on the data storage device 401 can be used to determine whether a particular ink supply system is compatible with a particular printer.

It has been explained above that the controller 6 (FIG. 1) is arranged to ensure that an ink supply system 4 is only provided with ink and solvent from compatible cartridges. Operations carried out by the printer 1 when an ink cartridge 2 and a solvent cartridge 3 are fitted to the printer 1 are now described with reference to the flowcharts of FIGS. 12 to 17.

Figure 12:
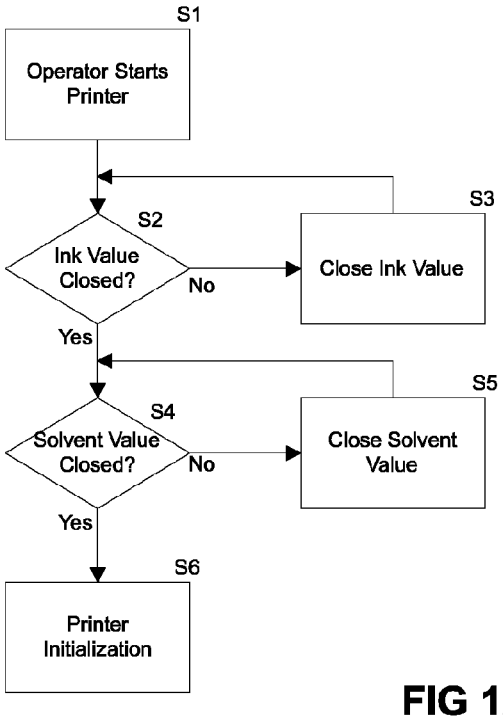
FIG. 12 is a flowchart showing printer initialisation operations carried out by the controller of FIG. 1.

Referring first to FIG. 12, at step S1 printer operation is initialised by a user. As described above, ink from the ink cartridge 2 flows to the ink supply system 4 through the valve 2*b*, and at step S2 a check is made to determine whether the valve 2*b* is closed. If the valve 2*b* is not closed, action is taken to close the valve 2*b* at step S3, and processing returns to step S2. If the valve is closed, processing passes from step S2 to step S4. Solvent from the solvent cartridge 3 passes to the ink supply system 4 though the valve 3*b*. A further check is carried out at step S4 to determine whether the valve 3*b* is closed. If this is not the case, processing passes from step S4 to step S5 where the valve 3*b* is closed, before processing returns to step S4. If the check of step S4 is satisfied, processing passes from step S4 to step S6 where various printer initialisation operations are carried out.

It can be seen from FIG. 12 that when printer operation begins, it is ensured that both the ink valve 2*b* and the solvent valve 3*b* are closed. This is to ensure that various checks are carried out (as described below) before any ink is transferred from the ink cartridge 2 to the ink supply system 4 and before any solvent is transferred from the solvent cartridge 3 to the ink supply system 4.

Figure 13:
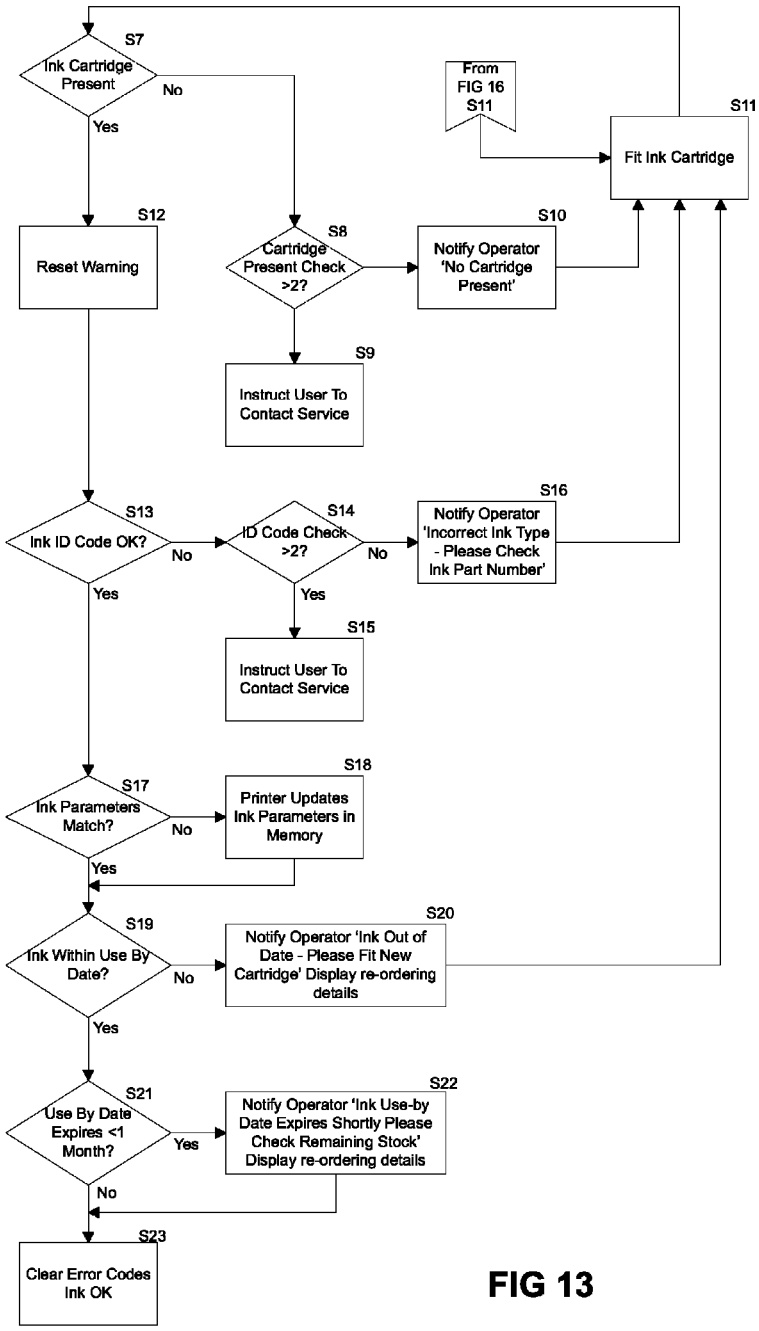
FIG. 13 is a flowchart showing operations carried out by the controller of FIG. 1 to check parameters associated with an ink cartridge.

Referring now to FIG. 13, checks carried out in relation to the ink cartridge 2 are described. At step S7 a check is carried out to determine whether an ink cartridge is inserted into the ink cartridge receiving portion 205 (FIG. 3B). If no ink cartridge is inserted, processing passes from step S7 to step S8 where a check is made to determine whether the check of step S7 has been carried out more than twice. If the check of step S8 is satisfied, processing passes to step S9, where a message is displayed on a user interface of the printer instructing the user to contact a service engineer. If however the check of step S8 determines that the check of step S7 has not been carried out more than twice, processing passes to step S10 where the user is presented with a message on the user interface of the printer indicating the absence of an ink cartridge. Processing passes from step S10 to step S11 where an ink cartridge is inserted into the ink cartridge receiving portion 205 by the user, at which time processing passes from step S11 back to step S7.

If the check of step S7 (arranged to determine whether an ink cartridge is present) is satisfied, processing passes from step S7 to step S12 where any error indication provided at step S10 is reset, before processing passes to step S13. At step S13 and subsequent steps data is read from the electronic data storage device 201 associated with the ink cartridge 2. At step S13 ink reference data 213 and fluid type data 214 indicating a type of ink held in the ink cartridge 2 is read from the electronic data storage device 201. A check is carried out to determine whether the type of ink held in the cartridge matches data indicating a type of ink which has previously been used in the ink supply system 4 (that data having been read from the electronic data storage device 401). If it is determined that the ink cartridge 2 contains a different type of ink from that previously used in the ink supply system 4, processing passes from step S13 to step S14. Here a counter indicating a number of times that incorrect ink has been detected is checked. If it is determined that there have been more than two previous checks which indicated that the ink cartridge 2 contained incorrect ink, processing passes to step S15 where the user interface displays a message indicating that the user should contact a service engineer. If however the counter indicates that there have not been more than two previous checks indicating that the ink cartridge 2 contained incorrect ink, processing passes from step S14 to step S16 where the user is informed that the ink cartridge contains incorrect ink. A user then inserts a further ink cartridge at step S11, before processing continues at step S7.

If it is determined at step S13 that the ink contained within the ink cartridge 2 and that used in the ink supply system 4 match, processing passes from step S13 to step S17, where a check is carried out to determine whether various ink parameters stored within the printer match those stored in the electronic data storage device 201. Such parameters can include time of flight data 215, temperature data 217 and pressure data 216 as shown in FIG. 10. If it is determined at step S17 that one or more ink parameters stored within the printer differ from those stored in the electronic data storage device 201, processing passes to step S18 where parameters stored within the printer are updated, before processing continues at step S19. If it is determined at step S17 that the parameters stored within the printer match data stored in the electronic data storage device 201, processing passes directly from step S17 to step S19. In this way variations in ink parameters can be properly handled by the printer 1.

At step S19, a check is made to compare a current date stored in the printer with expiry date data 219 (FIG. 10) stored in the electronic data storage device 201. If it is determined that the expiry date data 219 indicates that the ink cartridge can no longer be used, processing passes to step S20 where an appropriate message is displayed by means of the user interface, before a further cartridge is inserted at step S11.

If the check of step S19 indicates that the expiry date has not yet passed, processing passes from step S19 to step S21 where a check is carried out to determine whether the expiry date is within one month of a current date stored by the printer. If this is the case, an appropriate message is displayed at step S22 to advise the user to order further ink supplies, before processing continues at step S23 where any error indications are cleared from the user interface. If the check of step S21 indicates that the expiry date is not within one month of the current date stored by the printer, processing passes directly from step S21 to step S23.

Figure 14:
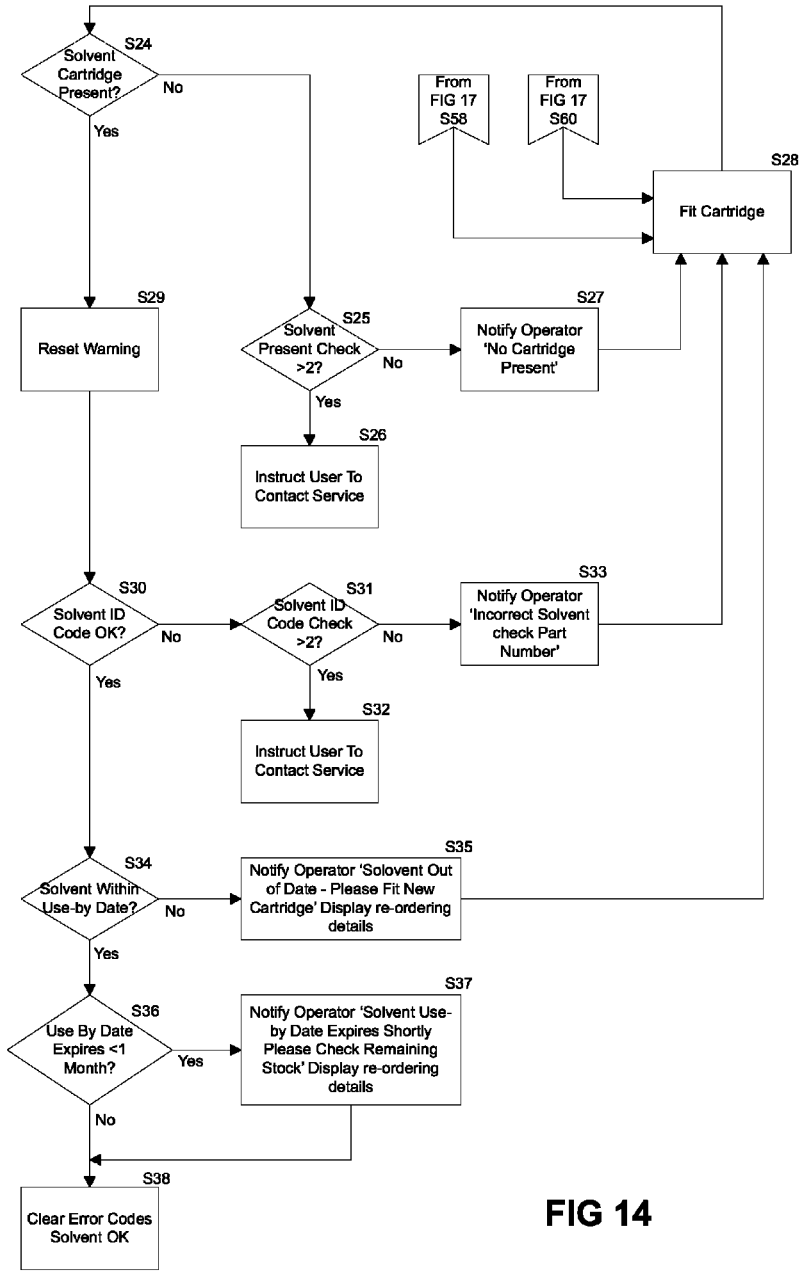
FIG. 14 is a flowchart showing operations carried out by the controller of FIG. 1 to check parameters associated with a solvent cartridge.

FIG. 14 shows operations carried out in relation to the solvent cartridge 3. The operations of FIG. 14 are essentially equivalent to those carried out in relation to the ink cartridge 2 as described with reference to FIG. 13, and the operations of FIG. 14 are therefore only briefly described.

At step S24 a check is carried out to determine whether the solvent cartridge 3 is inserted into the solvent cartridge receiving portion 305. If this check is not satisfied processing passes to step S25 where a check is carried out to determine a number of times which the check of step S24 has been performed. If the check of step S24 has been carried out more than twice, processing passes to step S26 where the user is advised to contact a service engineer. Otherwise, processing passes from step S25 to step S27 where the user is asked to insert a solvent cartridge. A solvent cartridge is inserted at step S28, and processing returns to step S24.

When the check of step S24 determines that a solvent cartridge is present, any warning message is reset at step S29. At step S30 a check is made to compare data stored in the electronic data storage device 301 and indicating the type of solvent contained in the solvent cartridge 3 with data indicating the expected solvent type, given the type of ink used within the ink supply system 4. If the incorrect solvent is contained in the solvent cartridge 3 processing passes from step S30 to step S31 where a check is carried out to determine whether the check of step S30 has been carried out too many times. If this is the case, a message is displayed on the user interface advising the user to contact a service engineer at step S32. Otherwise, processing passes from step S31 to step S33 where a message is displayed indicating that incorrect solvent is contained in the solvent cartridge 3, before a further solvent cartridge is inserted at step S28.

If the check of step S30 is satisfied, processing passes from step S30 to step S34 where a check is made to determine whether the solvent expiry date (as indicated by expiry date data stored in the electronic data storage device 301) has passed. If the expiry date has passed, processing passes from step S34 to step S35 where the user is advised to fit a further solvent cartridge to the printer. A further solvent cartridge is inserted at step S28.

If the expiry date has not passed, processing passes from step S34 to step S36 where a check is carried out to determine whether the solvent is within one month of its expiry date. If this is the case, an appropriate message is displayed at step S37 before processing continues at step S38 where any residual error indications are cleared. If the solvent is not within one month of its expiry date, processing passes directly from step S36 to step S38.

It has been explained above that the electronic data storage device 201 associated with the ink cartridge 2 stores data indicating a quantity of ink within the ink cartridge 2. Similarly, the electronic data storage device 301 associated with the solvent cartridge 3 stores data indicating a quantity of solvent within the solvent cartridge 3. Processing of this data is now described with reference to FIGS. 15, 16 and 17, the described processing being carried out after that shown in FIGS. 12, 13 and 14.

Figure 15:
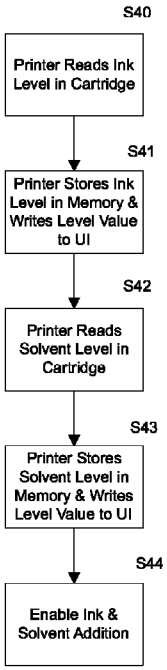
FIG. 15 is a flowchart showing operations carried out by the controller of FIG. 1 to determine initial volumes of fluid in an ink cartridge and a solvent cartridge.

Referring to FIG. 15, at step S40 data indicating the quantity of ink within the ink cartridge 2 is read by the printer 1 from the electronic data storage device 201. At step S41 the read data is stored by the printer 1 and also displayed to a user by means of a user interface. At step S42 the printer 1 reads data from the electronic data storage device 301 indicating a quantity of solvent contained in the solvent cartridge 3, and this data is stored by the printer 1 and displayed to a user at step S43. At step S44 valves 2*b* and 3*b* are opened so as to allow ink and solvent to pass from respective cartridges 2, 3 to the ink supply system 4. It should be noted that the valves 2*b* and 3*b* are opened at step S44 if but only if all the checks shown in FIGS. 13 and 14 are satisfied. In this way, the valves ensure that ink and solvent can be added to the ink supply system 4 only if checks relating to the ink and solvent are satisfied.

Figure 16:
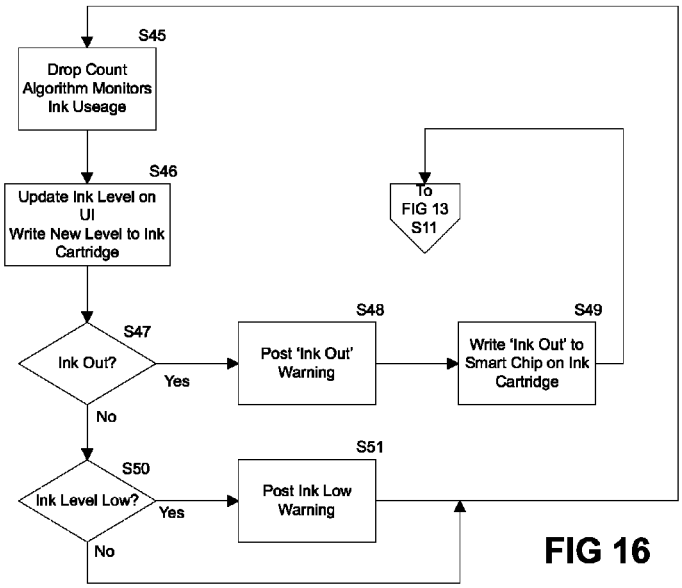
FIG. 16 is a flowchart showing operations carried out by the controller of FIG. 1 to update data indicating the volume of ink within an ink cartridge.

Updating of data indicating a quantity of ink within the ink cartridge 2 is now described with reference to FIG. 16. At step S45 an algorithm is operated which counts of number of droplets of ink which are projected from the printhead 5 onto a substrate. Given knowledge of the quantity of ink included in each droplet, the quantity of ink used can be determined, and this determined quantity is used to determine a modified quantity of ink within the ink cartridge 2, based on an assumption that ink removed from the reservoir 14 and used in printing is replenished with an equal quantity of ink from the ink cartridge 2. This modified quantity is used to update data stored in the electronic data storage device 201 and to provide appropriate data to the user by means of the user interface at step S46.

At step S47 a check is carried out to determine whether the algorithm of step S45 has determined that the ink cartridge 2 is empty. If this is the case, processing passes to step S48 where an appropriate message is displayed to the user via a user interface. Processing then continues at step S49 where data stored in the electronic data storage device 201 is appropriately updated. Processing passes from step S49 to step S9 of FIG. 13.

If the check of step S47 determines that the ink cartridge 2 is not empty, processing passes to step S50 where a check is carried out to determine whether there is a low level of ink within the ink cartridge 2. If this is the case, processing passes to step S51 where an appropriate message is displayed on the user interface of the printer 1. It can be seen that processing passes from each of steps S50 and S51 to step S45 so as to provide constant monitoring of the level of ink contained within the ink cartridge 2.

Figure 17:
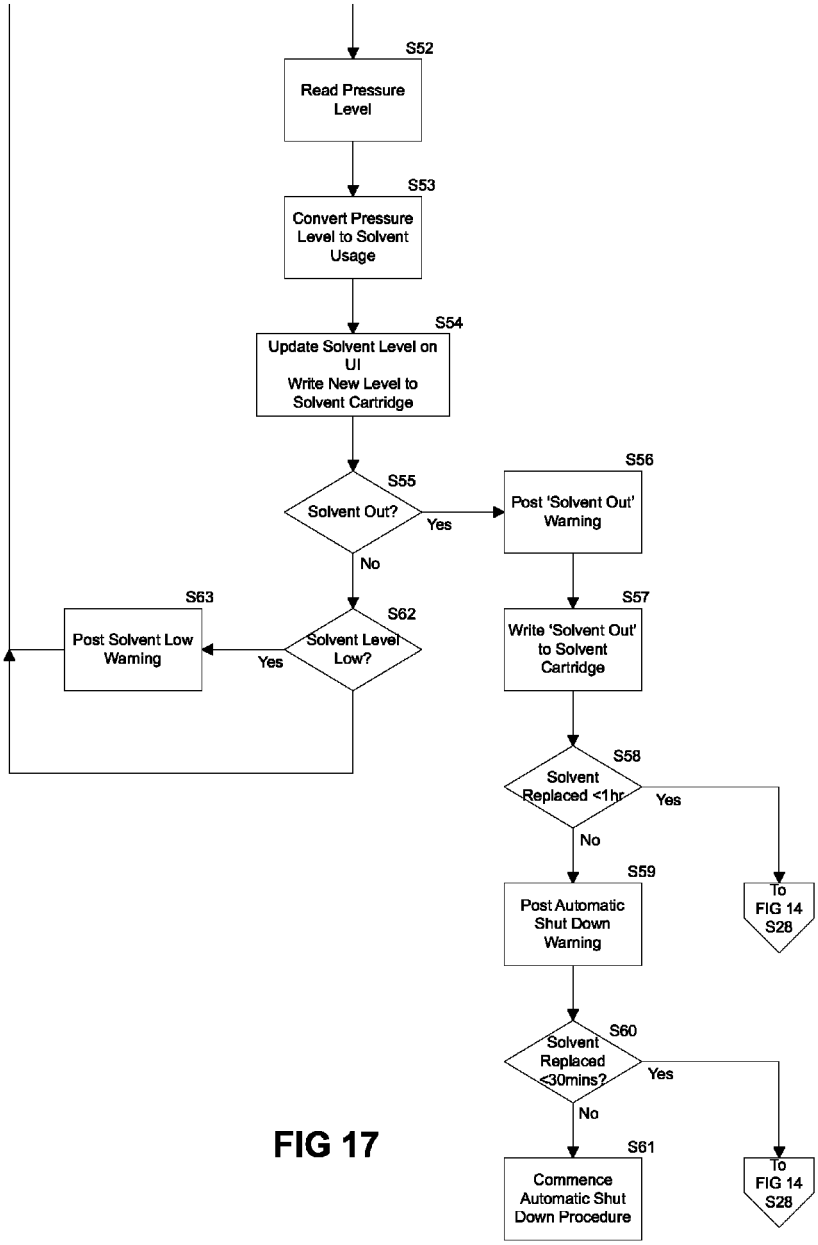
FIG. 17 is a flowchart of a process used by the controller of FIG. 1 to update data indicating a volume of solvent within a solvent cartridge.

Referring to FIG. 17, processing is described to monitor the quantity of solvent within the solvent cartridge 3. At step S52 the printer 1 reads a negative pressure within the solvent cartridge 3, and at step S53 the negative pressure is converted to a quantity of solvent within the solvent cartridge 3. In general terms, the negative pressure increases as quantity of solvent decreases. At step S54 the user interface is updated to indicate the determined quantity of solvent, and appropriate data is provided to the electronic storage device 301. At step S55 a check is carried out to determine whether the solvent cartridge 3 is empty. If this is the case, processing passes to step S56 where an appropriate message is displayed by means of the user interface. At step S57 appropriate data is provided to the electronic data storage device 301.

Processing passes from step S57 to step S58 where a check is carried out to determine whether the solvent cartridge has been replaced within one hour of display of the message at step S56, if this is the case processing as described with reference to FIG. 14 is carried out beginning at step S28. If the check of step S58 determines that the solvent cartridge has not been replaced, a warning message is displayed at step S59 indicating that the printer will shut down if the solvent cartridge is not replaced. At step S60 a check is carried out to determine whether the solvent cartridge has been replaced within thirty minutes of display of the message at step S59, if this is the case, processing as described with reference to FIG. 14 beginning at step S28 is carried out, otherwise, processing passes from step S60 to step S61 where the printer is shutdown.

If the check of step S55 determines that the solvent cartridge 3 is not empty, processing passes from step S55 to step S62 where a check is carried out to determine whether the quantity of solvent in the solvent cartridge 3 is below a predetermined level. If this is the case, an appropriate message is presented at step S63. It can be seen that processing returns from each of steps S62 and S63 to step S52, allowing constant monitoring of the quantity of solvent stored within the solvent cartridge 3.

It has been described above that the quantity of solvent contained within the solvent cartridge 3 is determined based upon negative pressure measurements, while the quantity of ink stored within the ink cartridge 2 is determined based upon a number of droplets of ink output from the printhead. In some embodiments, the quantity of ink is within the ink cartridge 2 is also determined based upon negative pressure measurements.

It will be appreciated that the volume of ink within the ink cartridge 2 and the solvent within the solvent cartridge 3 can be determined in any convenient way, and this determination can be used to update both an indication provided to a user on a user interface and data stored on the electronic data storage devices 201, 301. Storing an up to date indication of the quantity of fluid in each of the ink cartridge 2 and solvent cartridge 3 on respective electronic data storage devices 201, 301 is advantageous in that each of the ink cartridge 2 and the solvent cartridge 3 are provided with data accurately indicating a quantity of ink currently contained in the cartridge.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary. Reference to a controller is to be understood as a reference to any system or systems arranged to provide the necessary control. For example, control may be provided by one or more suitably programmed micro-processors or alternatively by one or more bespoke hardware devices.

The invention claimed is:

1. An ink jet printer comprising:

an ink cartridge receiving portion arranged to receive an ink cartridge and to allow passage of ink from a received ink cartridge to printing fluid conduits of the ink jet printer;

a solvent cartridge receiving portion arranged to receive a solvent cartridge and to allow passage of solvent from a received solvent cartridge to printing fluid conduits of the ink jet printer;

a data reader arranged to read data indicating a quantity of fluid within a received ink cartridge from an electronic data storage device associated with the received ink cartridge and arranged to read data indicating a quantity of fluid within a received solvent cartridge from an electronic data storage device associated with the received solvent cartridge;

an ink supply system comprising a mixer tank in communication with said ink cartridge and said solvent cartridge;

an electronic data storage device associated with the ink supply system; and a controller arranged to communicate with the electronic storage devices of the ink cartridge, the solvent cartridge, and the ink supply system, the controller further arranged to generate update data usable to modify data stored on each of said ink and solvent electronic data storage devices and to modify data stored on each of said ink and solvent electronic storage devices based upon said update data such that data stored on each of said ink and solvent electronic data storage devices indicates an updated quantity of fluid in each of said ink and solvent cartridges, wherein said controller is further arranged to determine a quantity of fluid within each of said ink and solvent cartridges based upon at least one property of fluid within each of said ink and solvent cartridges and to generate said update data based upon said determination;

wherein said ink jet printer is a continuous ink jet printer.

2. An ink jet printer according to claim 1, wherein said controller is arranged to determine a quantity of fluid within said printing fluid cartridge based upon a quantity of fluid removed from said printing fluid cartridge.

3. An ink jet printer according to claim 1, wherein said controller is arranged to determine a quantity of fluid within said printing fluid cartridge based upon a quantity of fluid used in printing operations.

4. An ink jet printer according to claim 1, wherein said at least one property is a pressure within said printing fluid cartridge.

5. An ink jet printer according to claim 1, wherein an electronic data storage device associated with the printing fluid cartridge stores first data indicating a quantity of fluid initially stored in said printing fluid cartridge, and second data indicating a quantity of fluid removed from the printing fluid cartridge.

6. An ink jet printer according to claim 5, wherein said update data is arranged to modify said second data.

7. An ink jet printer according to claim 5, wherein determining said update data comprises:

determining a current quantity of fluid in said printing fluid cartridge;

determining a difference between said initial quantity of fluid and said current quantity of fluid; and generating said update data based upon said difference.

8. An ink jet printer according to claim 1, wherein said electronic data storage device associated with the received ink cartridge and said electronic data storage device associated with the received solvent cartridge each include stored data comprising temperature data, batch code data, expiry date data, and insertions data.

9. An ink jet printer according to claim 1, wherein the electronic data storage device associated with the ink supply system includes data indicating a type of ink wherein the printer is operable to associate the ink supply system with a particular type of ink when the ink supply system is first used and prevent the ink supply system which has been used with one type of ink from later being used with an incompatible ink.

10. An ink jet printer according to claim 9, wherein the electronic data storage device associated with the ink supply includes stored data comprising temperature data and run hours data.

* * * * *